US010902793B2

(12) United States Patent
Oh et al.

(10) Patent No.: US 10,902,793 B2
(45) Date of Patent: Jan. 26, 2021

(54) GATE DRIVER CIRCUIT OUTPUTTING A PLURALITY OF EMISSION SIGNALS HAVING DIFFERENT DELAY TIMES OR PULSE WIDTHS OR COMBINATIONS THEREOF

(71) Applicant: LG DISPLAY CO., LTD., Seoul (KR)

(72) Inventors: SeungSeok Oh, Seoul (KR); CheolSe Kim, Daegu (KR); YoungJoon Lee, Gyeonggi-do (KR); SungYub Lee, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/563,653

(22) Filed: Sep. 6, 2019

(65) Prior Publication Data

US 2020/0082768 A1 Mar. 12, 2020

(30) Foreign Application Priority Data

Sep. 12, 2018 (KR) ..... 10-2018-0109241
Dec. 26, 2018 (KR) ..... 10-2018-0168965

(51) Int. Cl.
*G09G 3/3291* (2016.01)
*G09G 3/3233* (2016.01)
*G09G 3/3266* (2016.01)

(52) U.S. Cl.
CPC ..... *G09G 3/3291* (2013.01); *G09G 3/3233* (2013.01); *G09G 3/3266* (2013.01); *G09G 2310/0286* (2013.01); *G09G 2310/06* (2013.01); *G09G 2310/08* (2013.01); *G09G 2320/0247* (2013.01); *G09G 2330/021* (2013.01)

(58) Field of Classification Search
CPC ..... G09G 2310/0286; G09G 2310/06; G09G 2310/08; G09G 2320/0247; G09G 2330/021; G09G 3/3233; G09G 3/3266; G09G 3/3291
See application file for complete search history.

(56) References Cited

U.S. PATENT DOCUMENTS 6,646,625 B1 * 11/2003 Shigeta ..... G09G 3/2022 315/169.4
8,264,428 B2 * 9/2012 Nam ..... G09G 3/3233 345/76
9,548,022 B2 * 1/2017 Kim ..... G09G 3/3233
2009/0295785 A1 * 12/2009 Yamamoto ..... G09G 3/3233 345/214
2011/0012817 A1 * 1/2011 Nakamura ..... G09G 3/3233 345/80
2014/0313232 A1 * 10/2014 Han ..... G09G 3/3233 345/690

(Continued)

*Primary Examiner* — Chun-Nan Lin
(74) *Attorney, Agent, or Firm* — Seed IP Law Group LLP

(57) ABSTRACT

A gate driver circuit, a display panel, and a display device. A number of emission start signals, with at least one a delay time, a pulse width, or a combination thereof, are supplied in a frame period in which display driving is performed at a low driving frequency. This decreases a degree by which luminance appearing in the frame period is reduced, or changes characteristics of frequency components of luminance, thereby preventing flicker from being observed. The display driving is performed at the low driving frequency reduces power consumption, and is performed at a lower driving frequency to improve the efficiency of the display device.

9 Claims, 24 Drawing Sheets

(56) References Cited

U.S. PATENT DOCUMENTS

| | | | | |
|---|---|---|---|---|
| 2015/0348464 | A1* | 12/2015 | In | G09G 3/2022 345/205 |
| 2016/0293103 | A1* | 10/2016 | Kimura | G09G 3/3233 |
| 2016/0379560 | A1* | 12/2016 | Cho | G09G 3/3233 345/76 |

* cited by examiner

| Freq. | Normal | Asym. |
|---|---|---|
| Amp. (mV) | 7.61 | 0.42 |
| Flicker (dB) | −42.5 | −58.3 |

· Amplitude Measured at 19Hz

| Duty | #1 | #2 | #3 | #4 | #5 | 비고 |
|---|---|---|---|---|---|---|
| Normal | 99.7% | 100% | 100% | 100% | 100% | Ref. |
| Asym. | 93.5% | 92% | 93.5% | 96% | 98.5% | |

GATE DRIVER CIRCUIT OUTPUTTING A PLURALITY OF EMISSION SIGNALS HAVING DIFFERENT DELAY TIMES OR PULSE WIDTHS OR COMBINATIONS THEREOF

CROSS REFERENCE TO RELATED APPLICATIONS

This application claims priority from Korean Patent Application No. 10-2018-0109241, filed on Sep. 12, 2018, and Korean Patent Application No. 10-2018-0168965, filed on Dec. 26, 2018, which are hereby incorporated by reference for all purposes as if fully set forth herein.

BACKGROUND

Technical Field

Embodiments relate to a gate driver circuit, a display panel, and a display device.

Description of the Related Art

With the development of the information society, there has been increasing demand for a variety of image display devices. In this regard, a range of display devices, such as liquid crystal display (LCD) devices and organic light-emitting diode (OLED) display devices, have recently come into widespread use.

Among such display devices, OLED display devices have superior properties, such as rapid response speeds, high contrast ratios, high luminous efficiency, high luminance, and wide viewing angles, since self-emitting organic light-emitting diodes (OLEDs) are used.

Such an OLED display device can turn on organic light-emitting diodes disposed in subpixels of a display panel by controlling current flowing through the organic light-emitting diodes, thereby controlling the luminance of each of the subpixels to display images.

Here, a current flowing through each of the organic light-emitting diodes while the organic light-emitting diode is emitting light may be reduced due to an off-current or the like within the corresponding subpixel. Such a decrease in the amount of current driving the organic light-emitting diode may reduce the luminance of the organic light-emitting diode.

In particular, in a case in which the display device is driven at a low display driving frequency to reduce power consumption or the like, the degree by which the luminance is reduced may increase with increases in the amount of current reduced during the emission period. Such reduction in the luminance may be observed as flicker by a user, which is problematic.

BRIEF SUMMARY

Various embodiments provide a display panel and device able to decrease the degree by which the luminance of an organic light-emitting diode disposed in a subpixel is reduced during a period in which the organic light-emitting diode emits light.

Also provided are a display panel and device able to prevent flicker during low-frequency driving by maintaining luminance to be uniform or changing characteristics of a low-frequency component of luminance while display driving is being performed at a low display driving frequency.

Also provided are a gate driver circuit and a driving method thereof, by which the luminance of an organic light-emitting diode can be controlled to be uniform during a low-frequency driving period.

According to one embodiment, a display device may include: a display panel including a plurality of gate lines, a plurality of data lines, and a plurality of subpixels; a gate driver circuit configured to drive the plurality of gate lines; and a data driver circuit configured to drive the plurality of data lines.

In the display device, each of the plurality of subpixels may include a light-emitting element, a driving transistor configured to drive the light-emitting element, and a light-emitting transistor electrically connected between the light-emitting element and the driving transistor.

The gate driver circuit may output an emission signal to a gate line, through which the light-emitting transistor is controlled, and may output two or more emission signals in a luminance control driving period being at least a portion of a one-frame period.

In addition, the length of an off period of each of the two or more emission signals output in the luminance control driving period may gradually decrease.

Alternatively, at least one of a delay time, a pulse width, or a combination thereof, of the first emission signal among the plurality of emission signals, may be different from a corresponding one of the second emission signal among the plurality of emission signals.

According to another embodiment, a display panel may include: a plurality of gate lines; a plurality of data lines; light-emitting elements disposed in areas in which the gate lines overlap the data lines; a plurality of subpixels respectively including a driving transistor to drive a corresponding light-emitting element among the light-emitting elements and a light-emitting transistor electrically connected between the corresponding light-emitting element and the driving transistor; and a gate driver circuit outputting an emission signal to the gate lines through which the light-emitting transistors are driven. If a display driving frequency is a first driving frequency, the gate driver circuit may output a single emission signal in a one-frame period. If the display driving frequency is a second driving frequency lower than the first driving frequency, the gate driver circuit may output a plurality of emission signals in the one-frame period. The length of an off period of each of two or more emission signals, output in a luminance control driving period being at least a portion of a one-frame period, may gradually decrease.

According to another embodiment, a display panel may include: a plurality of subpixels; a light-emitting element in each subpixel of the plurality of subpixels; a driving transistor in each subpixel of the plurality of subpixels to drive the light-emitting element; and a light-emitting transistor in each subpixel of the plurality of subpixels electrically connected between the light-emitting element and the driving transistor, wherein, during a driving period in a low-power mode, a plurality of emission signals are applied to the light-emitting transistor in a luminance control driving period that is at least a portion of a one-frame period, a delay time, a pulse width, or a combination thereof of one emission signal is different from a delay time, a pulse width, or a combination thereof, respectively, of the remaining emission signals.

According to another embodiment, a gate driver circuit may include: a scan signal output circuit configured to output a scan signal at a display driving frequency; and an emission signal output circuit configured to output one or more emission signals at the display driving frequency in a one-frame period.

Here, in a case in which the emission signal output circuit outputs a plurality of emission signals in the one-frame period, the length of an off period of each of two or more emission signals, output in a luminance control driving period being at least a portion of a one-frame period, may gradually decrease.

Alternatively, the emission signal output circuit may output a plurality of emission signals in the luminance control driving period, with at least one of a delay time, a pulse width, or a combination thereof, of one emission signal, being different from a corresponding one of remaining emission signals.

According to exemplary embodiments, two or more pulse width modulated (PWM) emission signals can be output in a period in which the organic light-emitting diode is turned on, so that the luminance of the organic light-emitting diode can be reduced by a lesser degree.

In addition, the pulse width of each PWM emission signal can be controlled to ensure that luminance is the same while the PWM emission signal is being output, so that flicker due to reduced luminance can be prevented during a low-frequency driving period.

In addition, the pulse width of an emission signal can be modulated using an emission start signal, an emission reset signal, or the like, and thus, a gate driver circuit able to control luminance during the low-frequency driving period can be easily provided.

Furthermore, at least one of a delay period and a pulse width of the emission signal can be varied so that characteristics of frequency components of the luminance of the organic light-emitting diode are changed. Accordingly, it is possible to decrease the frequency components, which would otherwise cause flicker, thereby reducing the phenomenon in which flicker appears during the low-frequency driving period.

BRIEF DESCRIPTION OF THE SEVERAL VIEWS OF THE DRAWINGS

The above and other features and advantages of the present disclosure will be more clearly understood from the following detailed description, taken in conjunction with the accompanying drawings, in which.

DETAILED DESCRIPTION

Figure 1:
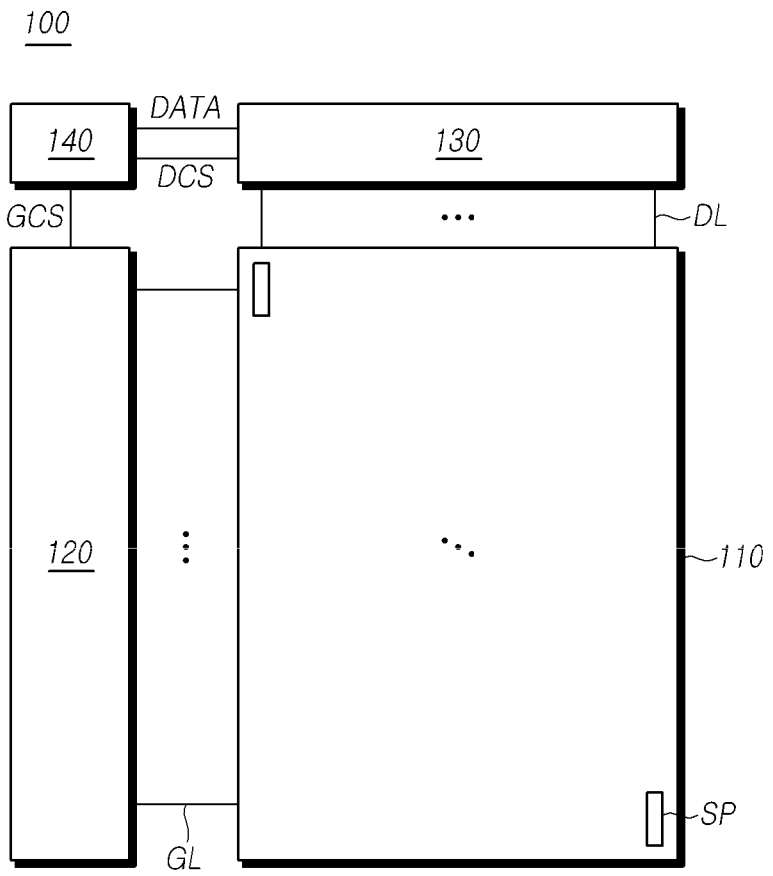
FIG. 1 illustrates a schematic configuration of a display device according to embodiments.

Hereinafter, some embodiments of the present disclosure will be described in detail with reference to the accompanying illustrative drawings. In designating elements of the drawings by reference numerals, the same elements will be designated by the same reference numerals although they are shown in different drawings. Further, in the following description of the present disclosure, a detailed description of known functions and configurations incorporated herein will be omitted when it may make the subject matter of the present disclosure rather unclear.

In addition, terms, such as first, second, A, B, (a), (b) or the like may be used herein when describing components of the present disclosure. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 illustrates a schematic configuration of a display device 100 according to embodiments.

Referring to FIG. 1, the display device 100 according to embodiments may include a display panel 110 in which a plurality of subpixels SP including light-emitting elements are arrayed, as well as components for driving the display panel 110, such as a gate driver circuit 120, a data driver circuit 130, and a controller 140.

In the display panel 110, a plurality of gate lines GL and a plurality of data lines DL are disposed, and a plurality of subpixels SP are arrayed in areas in which the gate lines GL overlap the data lines DL. Each of the plurality of subpixels SP may include a plurality of circuit elements, and two or more subpixels may constitute a single pixel.

The gate driver circuit 120 is controlled by the controller 140, and controls the driving timing of the plurality of subpixels SP by sequentially outputting a scan signal to the plurality of gate lines GL disposed in the display panel 110. In addition, the gate driver circuit 120 may output an emission signal to control the emission timing of the subpixels SP. The circuit outputting the scan signal and the circuit outputting the emission signal may be provided integrally or separately.

The gate driver circuit 120 may include one or more gate driver integrated circuits (GDICs), and may be disposed on one or both sides of the display panel 110 depending on the driving system.

The data driver circuit 130 receives image data from the controller 140, and converts the image data into an analog data voltage. In addition, the data driver circuit 130 outputs the data voltage to the data lines DL in the timing in which the scan signal is applied through the gate lines GL, so that each of the subpixels SP expresses luminance according to the image data.

The data driver circuit 130 may include one or more source driver integrated circuits (SDICs).

The controller 140 supplies a variety of control signals to the gate driver circuit 120 and the data driver circuit 130, and controls the operations of the gate driver circuit 120 and the data driver circuit 130.

The controller 140 controls the gate driver circuit 120 to output the scan signal in timing realized in each frame, converts image data, received from an external source, into a data signal format readable by the data driver circuit 130, and outputs the converted image data to the data driver circuit 130.

The controller 140 receives a variety of timing signals, including a vertical synchronization signal VSYNC, a horizontal synchronization signal HSYNC, an input data enable signal DE, a clock signal CLK, and the like, from an external source (e.g., a host system).

The controller 140 can generate a variety of control signals using the variety of timing signals received from the external source, and output the variety of control signals to the gate driver circuit 120 and the data driver circuit 130.

For example, the controller 140 outputs a variety of gate control signals GCS, including a gate start pulse signal GSP, a gate shift clock signal GSC, a gate output enable signal GOE, and the like, to control the gate driver circuit 120.

Here, the gate start pulse signal is used to control the operation start timing of one or more GDICs of the gate driver circuit 120. The gate shift clock signal GSC is a clock signal commonly input to the one or more GDICs to control the shift timing of the scan signal. The gate output enable signal GOE designates timing information of the one or more GDICs.

In addition, the controller 140 outputs a variety of data control signals DCS, including a source start pulse signal SSP, a source sampling clock signal SSC, a source output enable signal SOE, and the like, to control the data driver circuit 130.

Here, the source start pulse signal SSP is used to control the data sampling start timing of one or more SDICs of the data driver circuit 130. The source sampling clock signal SSC is a clock signal controlling the sampling timing of data in each of the SDICs. The source output enable signal SOE controls the output timing of the data driver circuit 130.

The touch display device 100 may further include a power management IC supplying various forms of voltage or current to the display panel 110, the gate driver circuit 120, the data driver circuit 130, and the like, or controls various forms of voltage or current to be supplied to the same.

Voltage lines, through which a variety of signals and voltages are supplied, may be disposed in the display panel 110, in addition to the gate lines GL and the data lines DL. In each of the subpixels SP, light-emitting elements, transistors for driving the light-emitting elements, and the like may be disposed.

Figure 2:
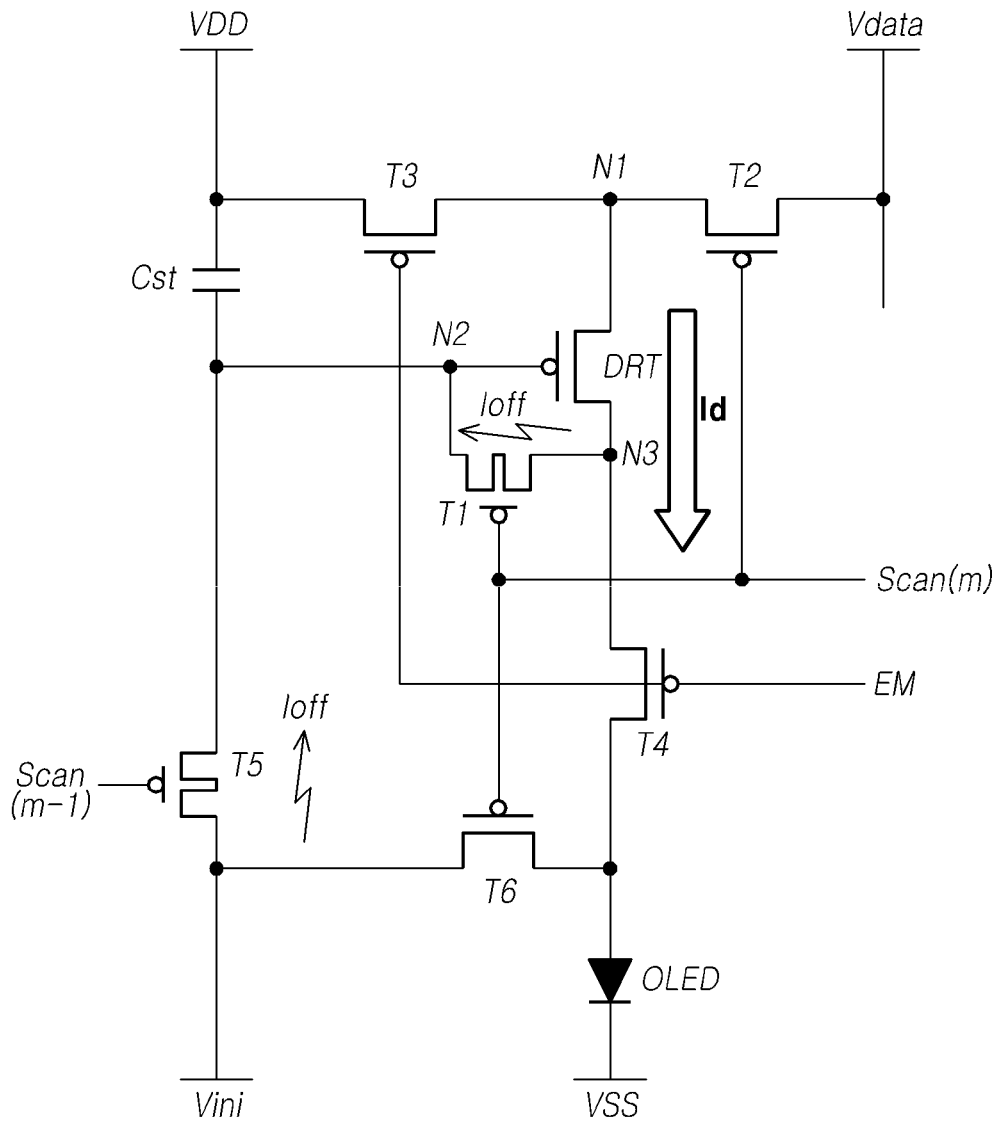
FIG. 2 illustrates a circuit structure of each of the subpixels arrayed in the display panel of the display device according to embodiments.

FIG. 2 illustrates a circuit structure of each of the subpixels SP arrayed in the display panel 110 of the display device 100 according to embodiments. Here, the display device 100 is illustrated as being an organic light-emitting diode (OLED) display device by way of example.

Descriptions of embodiments will be mainly focused on the OLED display device. However, embodiments are not limited thereto and are applicable to inorganic light-emitting diode display devices.

Referring to FIG. 2, an organic light-emitting diode OLED is disposed in the subpixel SP according to embodiments, and a driving transistor DRT is provided to drive the organic light-emitting diode OLED by controlling current flowing through the organic light-emitting diode OLED. One or more transistors, other than the driving transistor DRT, may be provided, and a storage capacitor Cst for maintaining the voltage of a gate node of the driving transistor DRT for a one-frame time may be provided.

FIG. 2 illustrates a 7T1C structure of the subpixel SP, in which seven transistors, including the driving transistor DRT, and the single storage capacitor Cst are provided. Here, two or more transistors can be connected to each other and perform the same function to serve as a single transistor. In addition, although the subpixel SP is illustrated as being a transistor in the form of a P-channel metal-oxide-semiconductor (PMOS) in FIG. 2, the subpixel SP may be provided as a transistor in the form of an N-channel metal-oxide-semiconductor (NMOS).

In the organic light-emitting diode OLED, an anode may be electrically connected to the driving transistor DRT, and a base voltage VSS may be applied to a cathode electrode.

The driving transistor DRT may be electrically connected between a driving voltage line, through which a driving voltage VDD is applied, and the organic light-emitting diode OLED. In addition, the driving transistor DRT may be electrically connected to a data line DL, through which a data voltage Vdata is applied. In addition, a gate node of the driving transistor DRT is electrically connected to the storage capacitor Cst and an initialization voltage line.

A first transistor T1 is electrically connected between a second node N2 and a third node N3 of the driving transistor DRT. The first transistor T1 causes a voltage, obtained by compensating the data voltage Vdata for the threshold voltage Vth of the driving transistor DRT, to be applied to the gate node of the driving transistor DRT.

A second transistor T2 is electrically connected between the first node N1 of the driving transistor DRT and the data line DL, and a third transistor T3 is electrically connected between the first node N1 of the driving transistor DRT and the driving voltage line.

A fourth transistor T4 is electrically connected between the third node N3 of the driving transistor DRT and the organic light-emitting diode OLED. The fourth transistor T4 controls emission timing of the organic light-emitting diode OLED, and may be referred to as an "light-emitting transistor."

A fifth transistor T5 is electrically connected between the second node N2 of the driving transistor DRT and the initialization voltage line. The fifth transistor T5 is used to initialize the voltage of the gate node of the driving transistor DRT.

A sixth transistor T6 is electrically connected between the anode of the organic light-emitting diode OLED and the initialization voltage line. The sixth transistor T6 is used to initialize the voltage of the anode of the organic light-emitting diode OLED.

Describing the driving method of the subpixel SP, the subpixel SP can be driven separately in a data update period and a data retaining period during a single image frame period.

The fifth transistor T5 is turned on in the data update period, and an initialization voltage Vini is applied to the gate node of the driving transistor DRT.

In addition, the fifth transistor T5 is turned off and the sixth transistor T6 is turned on, so that the initialization voltage Vini is applied to the anode of the organic light-emitting diode OLED.

In addition, the first transistor T1 and the second transistor T2 are turned on. When the second transistor T2 is turned on, the data voltage Vdata is applied to the first node N1 of the driving transistor DRT.

Since the first transistor T1 is in a turned-on state, a voltage obtained by adding the data voltage Vdata and the threshold voltage Vth of the driving transistor DRT is applied to the second node N2 of the driving transistor DRT. Since the voltage obtained by adding the data voltage Vdata and the threshold voltage Vth of the driving transistor DRT is applied to the second node N2 of the driving transistor DRT, compensation for the threshold voltage Vth of the driving transistor DRT is performed.

In the data retaining period, the third transistor T3 and the fourth transistor T4 are turned on, and the driving voltage VDD is applied to the first node N1 of the driving transistor DRT. In addition, in response to a voltage applied to the gate node of the driving transistor DRT, a current flows through the organic light-emitting diode OLED, thereby turning the organic light-emitting diode OLED on.

Here, in a state in which the first transistor T1 is turned off in the data retaining period, an off-current may be generated. Since the first transistor T1 is connected between the second node N2 and the third node N3 of the driving transistor DRT, the off-current of the first transistor T1 can influence the voltage of the second node N2 of the driving transistor DRT.

In addition, an off-current may be generated through the fifth transistor T5 connected between the second node N2 of the driving transistor DRT and the initialization voltage line. The off-current, generated in this manner, can influence the voltage of the second node N2 of the driving transistor DRT.

Such an off-current can gradually increase the voltage Vg of the gate node of the driving transistor DRT. In response to the increase in Vg, a difference in voltage Vgs between the first node N1 and the second node N2 of the driving transistor DRT may be reduced, thereby reducing a current Id flowing through the organic light-emitting diode OLED and reducing the luminance of the organic light-emitting diode OLED.

In addition, the reduced luminance may be more obvious with increases in the data retaining period.

Figure 3A:
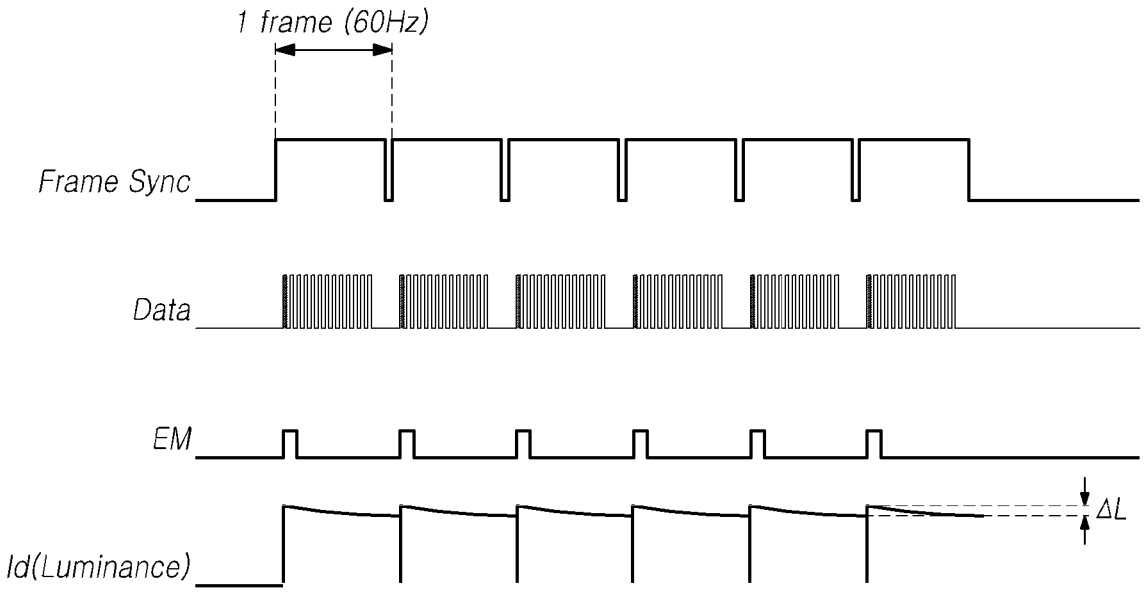
FIGS. 3A and 3B illustrate examples of changes in the luminance of each of the subpixels in a normal mode and a low-power mode of the display device according to embodiments.
Figure 3B:
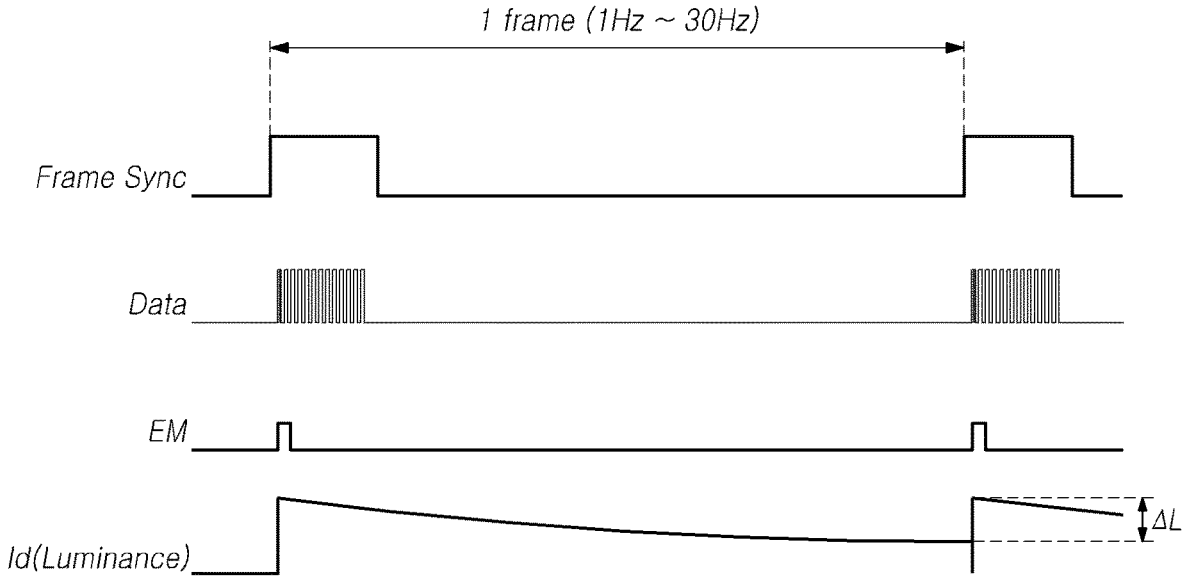

FIGS. 3A and 3B illustrate examples of changes in the luminance of each of the subpixels SP in a normal mode and a low-power mode of the display device 100 according to embodiments.

Referring to FIG. 3A, the display device 100 is illustrated as operating in the normal mode at a display driving frequency 60 Hz, by way of example.

After the data update period in each frame period, the voltage of the gate node of the driving transistor DRT increases due to an off-current in the subpixel SP during a data retaining period. Accordingly, a current Id flowing through the organic light-emitting diode OLED may be reduced, thereby reducing luminance.

Referring to FIG. 3B, when the display device 100 operates in the low-power mode, for example, at a display driving frequency 30 Hz or lower, luminance may be further reduced with increases in the data retaining period.

Such a reduction in luminance may increase luminous deviations among frames, and thus, may be observed as flicker on the display panel 110.

The display device 100 according to embodiments can apply a pulse width modulated (PWM) emission signal to the subpixels SP in the low-power mode during the data retaining period, so that luminance can be reduced by a lesser degree.

Figure 4A:
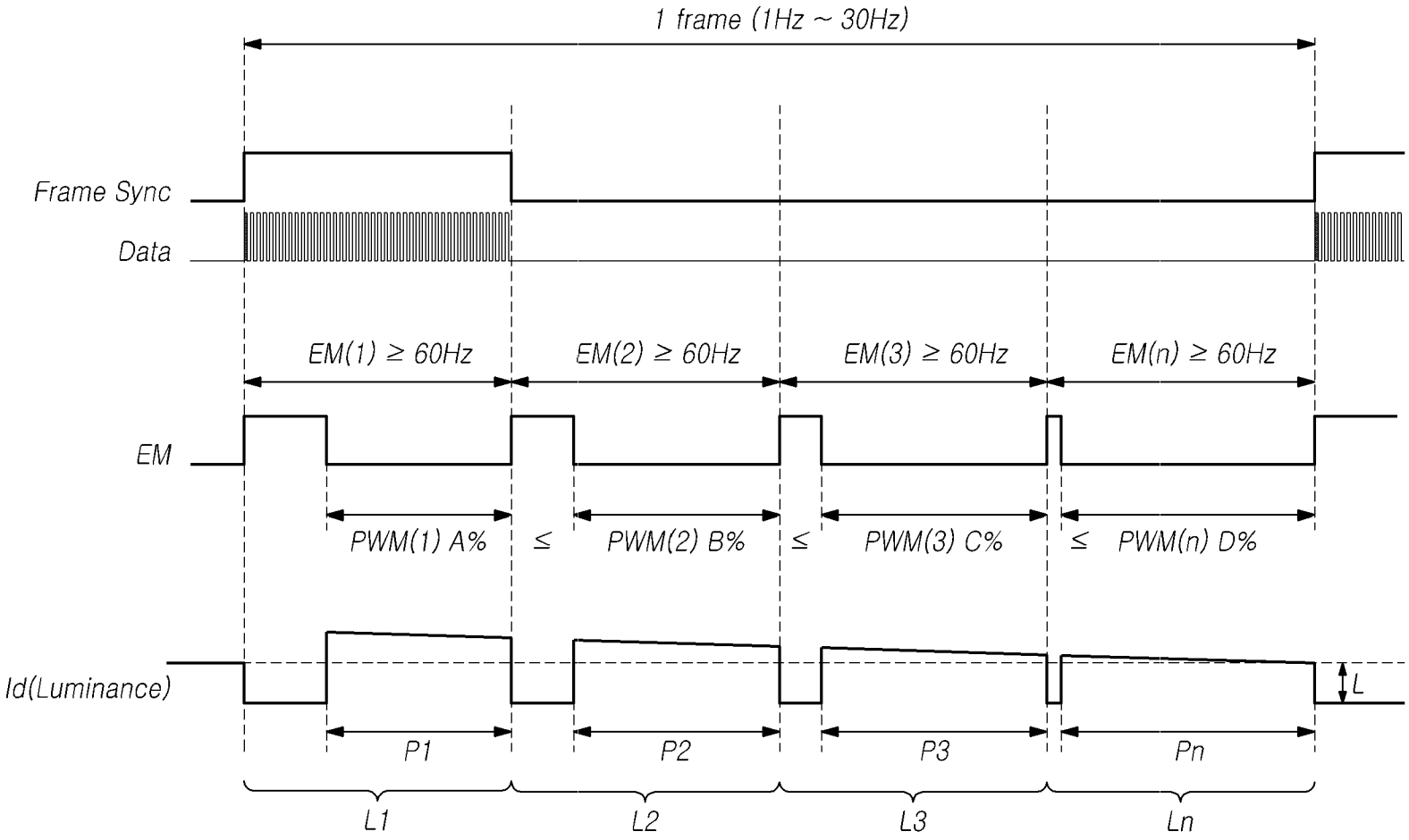
FIGS. 4A to 4C illustrate examples of a PWM emission signal output in the display device according to embodiments.
Figure 4B:
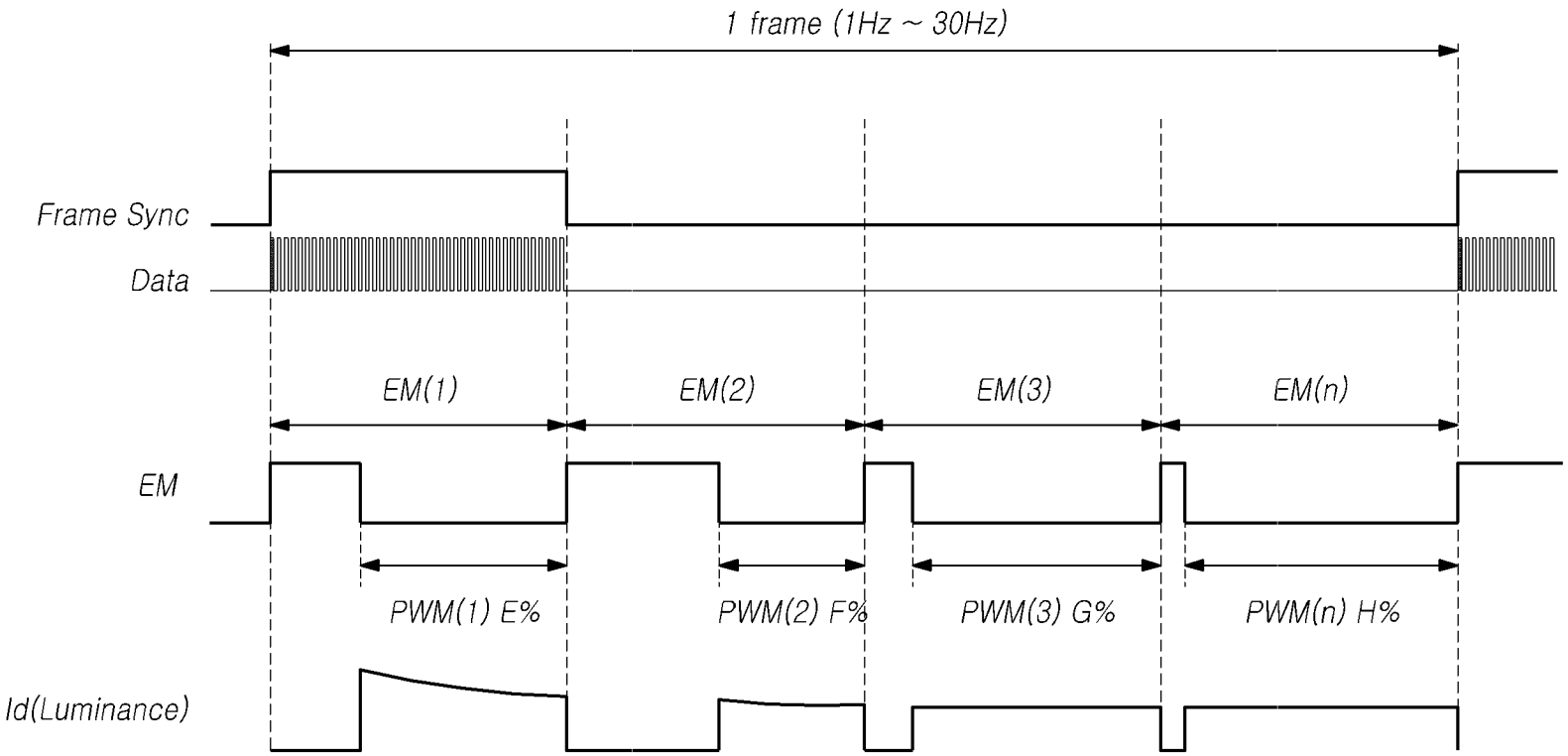
Figure 4C:
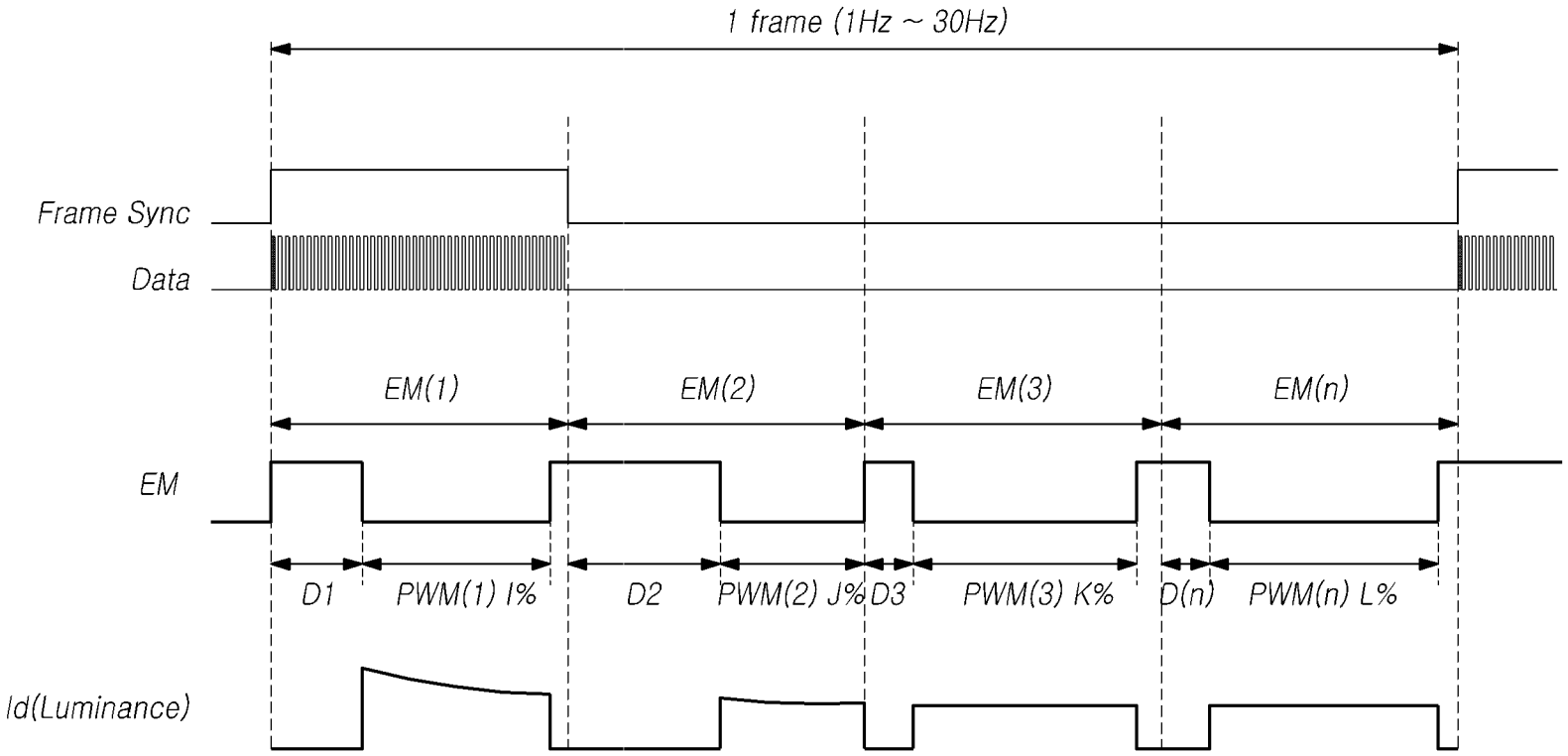

FIGS. 4A to 4C illustrate examples of a PWM emission signal and changes in the luminance of each of the subpixels SP in a low-power mode of the display device 100 according to embodiments.

Referring to FIG. 4A, a data voltage Vdata is supplied to each of subpixels SP during a data update period of a one-frame period. During the data update period, an emission signal applied to a light-emitting transistor disposed in the subpixel SP maintains a level at which the light-emitting transistor is turned off.

For example, when the light-emitting transistor is disposed in the form of a PMOS transistor, a high-level emission signal can be applied to a gate node of the light-emitting transistor during the data update period.

An emission signal applied to the light-emitting transistor during a data retaining period after the data update period maintains a level at which the light-emitting transistor is turned on. For example, the emission signal applied may be a low-level emission signal.

Here, during the data retaining period, one or more PWM emission signals may be applied to the light-emitting transistor. That is, n number of emission signals may be applied to the light-emitting transistor during the one-frame period. The emission signals may have different pulse widths.

For example, an emission signal EM(1) applied first to the light-emitting transistor may have a level by which the light-emitting transistor is turned on by a length corresponding to A % of the length of the emission signal. In addition, an emission signal EM(2) applied second may have a level by which the light-emitting transistor is turned on by a length corresponding to B % of the length of the emission signal. In addition, emission signals EM(3) and EM(n) may have levels by which the light-emitting transistor is turned on by lengths corresponding to C % and D % of the length of the emission signal, respectively.

Here, the length of the period in which each of the emission signals turns on the light-emitting transistor may gradually increase (e.g., $A \leq B \leq C \leq D$).

Thus, it may be understood that, in the periods corresponding to the emission signals, the period in which the light-emitting transistor is turned on gradually increases, while the period in which the light-emitting transistor is turned off gradually decreases. In addition, in the periods corresponding to the emission signals, the period in which an organic light-emitting diode OLED emits light may gradually increase (e.g., P1≤P2≤P3≤P4).

Here, during the data retaining period, the amount of current flowing through the organic light-emitting diode OLED may gradually decrease due to an off-current or the like. In addition, as the period in which the light-emitting transistor is turned on gradually increases in the period corresponding to each emission signal, the luminance of the organic light-emitting diode OLED can be uniform during the period corresponding to each emission signal (e.g., L1=L2=L3=L4).

That is, the light-emitting transistor can be turned on and off by applying a number of PWM emission signals in the one-frame period, so that the degree by which the luminance of the organic light-emitting diode OLED is reduced can be decreased.

In addition, the period in which the light-emitting transistor is turned on can be increased with decreases in the amount of current flowing through the organic light-emitting diode OLED, so that luminance appearing during the periods corresponding to the emission signals, of the one-frame period, can be maintained to be uniform.

The frequency at which the emission signal is applied may be set to a predetermined level or higher (e.g., 60 Hz or higher), in consideration of human visual perception. In addition, the output frequency of the emission signal may be set to be an integer multiple of the display driving frequency.

That is, since the one-frame period is divided into n number of periods having the same length, in each of which the PWM emission signal is applied to the light-emitting transistor, the output frequency of the emission signal can be n times the display driving frequency.

As described above, a number of PWM emission signals can be output in the entirety or a portion of the frame period in the low-power mode. Accordingly, it is possible to maintain luminance to be uniform and reduce changes in luminance, thereby improving image quality in the low-power mode.

In addition, it is possible to vary the pulse width of an emission signal by adjusting frequency components of luminance appearing in the frame period of the low-power mode, so that a frequency component that causes flicker can be reduced.

Referring to FIG. 4B, the emission signal EM(1) applied first to the light-emitting transistor in the frame period of the low-power mode can have a level at which the light-emitting transistor is turned on by a length corresponding to E % of the length of the emission signal. In addition, the emission signal EM(2) applied second can have a level at which the light-emitting transistor is turned on by a length corresponding to F % of the length of the emission signal. In addition, the emission signals EM(3) and EM(n) applied can have levels at which the light-emitting transistor is turned on by lengths corresponding to G % and H % of the length of the emission signal, respectively.

At least two emission signals among such emission signals may turn on the light-emitting transistor for different lengths of periods, i.e., may have different pulse widths. That is, at least two emission signals, by which the light-emitting transistor is turned on for different lengths of periods, may be present among the emission signals EM(1) to EM(n).

In addition, the pulse width of each emission signal may be randomly varied.

In addition, the emission signals applied to different gate lines GL during corresponding periods may have different pulse widths.

That is, the pulse widths of the emission signals can be varied so that the frequency component that causes flicker to be observable can be cancelled or reduced from among frequency components of luminance appearing during the frame period.

Specifically, if the pulse widths of the emission signals are the same, luminance gradually decreases during the frame period. Thus, different frequency components of luminance may appear in the periods corresponding to the emission signals.

Here, adjusting the pulse widths of the emission signals can change characteristics of frequency components of luminance appearing in the periods corresponding to the emission signals. In addition, with changes in the frequency components of luminance appearing in the periods corresponding to the emission signals, a specific frequency component among the frequency components of luminance appearing in the periods corresponding to the emission signals can be cancelled.

Accordingly, a frequency component that causes flicker, among the frequency components of luminance appearing in the frame period, can be reduced.

As described above, the characteristics of the frequency components of luminance appearing in the frame period can be changed by adjusting the pulse widths of the emission signals, so that no flicker can be observed during the frame period of the low-power mode while luminance can be maintained at a predetermined level.

In addition, it is possible to adjust delay periods together with the pulse widths of the emission signals in order to avoid the frequency component that causes flicker.

Referring to FIG. 4C, the pulse width of the emission signal EM(1) applied first during the frame period of the low-power mode may correspond to I % of the length of the emission signal EM(1). In addition, the pulse widths of the emission signals EM(2), EM(3), and EM(n) may be J %, K %, and L % of the length of the emission signal EM(1), respectively. In addition, the pulse widths of at least two emission signals of such emission signals may be different from each other.

Here, the delay periods of the emission signals may have different lengths.

The term "delay period" used herein may mean a period ranging from a point in time at which the emission signal is started to a point in time at which the emission signal is changed to a turn-on level.

For example, the length of the delay period of EM(1) may be D1, and the lengths of the delay periods of EM(2), EM(3), and EM(n) may be D2, D3, and D(n). In addition, at least two emission signals among such emission signals may be different lengths of delay periods.

In addition, a sum of the length of the delay period and the length of the pulse width of the emission signal may be the same as the length of the emission signal or may be shorter than the length of the emission signal.

As illustrated in FIG. 4C, the sum of the length of the delay period and the length of the pulse width of EM(1) may be shorter than the length of EM(1). In addition, the sum of the length of the delay period and the length of the pulse width of EM(2) may be the same as the length of EM(2).

Accordingly, as the length of the delay period of each emission signal is varied, the start point and the end point of the period in which the light-emitting transistor is turned on, of the period corresponding to the emission signal, may be varied.

That is, due to the adjustment of the delay period and the pulse width of each emission signal, a period in which the light-emitting transistor is turned off after being turned on may be present in the period corresponding to the emission signal. This may be regarded as the length of the emission signal being varied.

As described above, in the period corresponding to each emission signal, the point in time at which the light-emitting transistor is turned on, the length of the period in which the light-emitting transistor remains turned on, and the point in time at which the emitting transistor is turned off are varied, so that the characteristics of the frequency components of luminance appearing in the period corresponding to the emission signal can be easily changed.

In addition, due to such changes in the characteristics of the frequency components of luminance in the period corresponding to each emission signal, the frequency component that causes flicker, from among the frequency components of luminance appearing in the frame period, can be easily canceled.

Herein, the period in which the PWM emission signal is applied will be referred to as a "luminance control driving period." The luminance control driving period may be a period including both the data update period and the data retaining period or may be at least a portion of the data retaining period.

The emission signal can be output by the gate driver circuit 120 outputting a scan signal or by a circuit disposed separately from the gate driver circuit 120.

Figure 5:
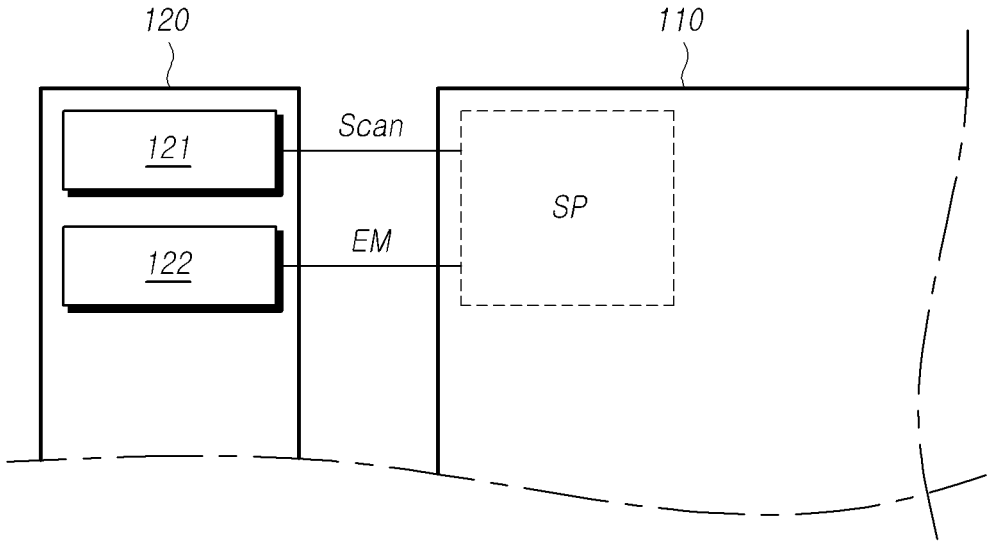
FIG. 5 illustrates an example of a configuration of the gate driver circuit outputting an emission signal in the display device according to embodiments.

FIG. 5 illustrates an example of a configuration of the gate driver circuit 120 outputting an emission signal in the display device 100 according to embodiments.

Referring to FIG. 5, the gate driver circuit 120 according to embodiments may include a scan signal output device 121 outputting a scan signal to subpixels SP arrayed in the display panel 110 and an emission signal output device 122 outputting an emission signal.

The scan signal output device 121 outputs the scan signal to the subpixels SP through gate lines GL. The scan signal output device 121 can output the scan signal according to a data update period of a frame period.

The emission signal output device 122 outputs the emission signal to the subpixels SP through the gate lines GL. The emission signal output device 122 can output the emission signal having a level, at which the light-emitting transistor is turned on, to the light-emitting transistor in the data retaining period of the frame period.

The emission signal output device 122 can output one or more emission signals during the frame period, depending on the display driving frequency of the display device 100.

For example, when the display device 100 is driven at a first driving frequency, the emission signal output device 122 can respectively output a single emission signal to the gate lines GL in a one-frame period.

That is, in the single-frame period, a single emission signal having a level, at which the light-emitting transistor is turned off during the data update period, and a level, at which the light-emitting transistor is turned on during the data retaining period, can be output. Alternatively, two or more emission signals having the same pulse widths can be output.

In addition, in a case in which the display device 100 is driven at a second driving frequency lower than the first driving frequency, the emission signal output device 122 can output two or more emission signals to each of the gate lines GL in the one-frame period, and at least one of the output emission signals may be a PWM signal.

For example, the one-frame period is divided into n number of periods, in each of which a single emission signal having a level, at which the light-emitting transistor is turned off, and a level, at which the light-emitting transistor is turned on, can be output.

In addition, the emission signals output in the divided periods, respectively, may have different pulse widths.

In an example, in the one-frame period, the emission signal output first may have a longest off-period, while the emission signal output nth may have a shortest off-period. That is, the first emission signal may have a shortest on-period, while the nth emission signal may have a longest on-period.

In another example, at least two emission signals among the number of emission signals output during the one-frame period may have different delay periods, different pulse widths, or different delay periods and pulse widths. In addition, emission signals output to different gate lines GL in a period corresponding to the one-frame period may have different delay periods, different pulse widths, or different delay periods and pulse widths.

As described above, the emission signal output device 122 can output the number of PWM emission signals in the period in which the display device 100 is driven at a second driving frequency, i.e., a lower display driving frequency, so that luminance intensity can be maintained to be uniform and changes in luminance intensity can be reduced in the data retaining period.

In addition, it is possible to reduce the frequency component that causes flicker, among frequency components of luminance appearing in the period driving at the second driving frequency, thereby preventing flicker from being observable while maintaining luminance at a predetermined level.

Here, the pulse width of the emission signal output in the low-power mode can be set on the basis of the level of the data voltage Vdata supplied to each of the subpixels SP or a value obtained by sensing a current flowing through the organic light-emitting diode OLED in response to the supplied data voltage Vdata.

Figure 6:
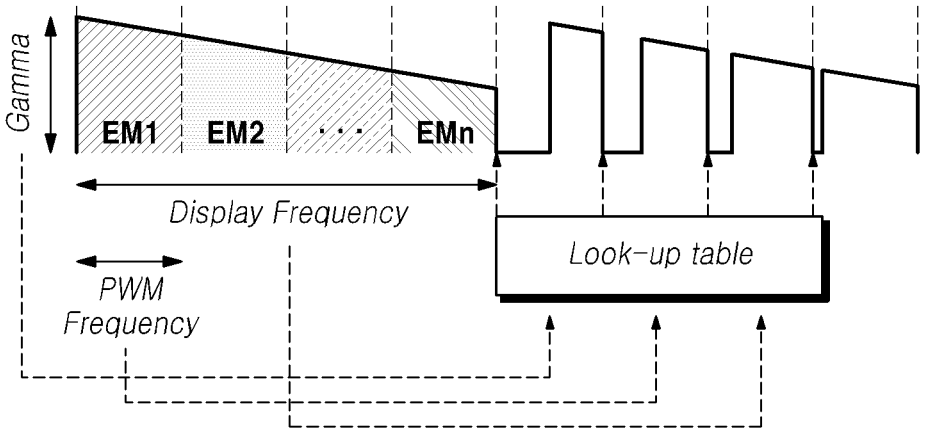
FIG. 6 illustrates an example of a method in which the display device according to embodiments sets the pulse width of the emission signal.

FIG. 6 illustrates an example of a method in which the display device 100 according to embodiments sets the pulse width of the emission signal.

Referring to FIG. 6, the pulse widths, i.e., duty ratios, of the number of emission signals output in the low-power mode may be set on the basis of a gamma value used for output of the data voltage Vdata, a display driving frequency, and an output frequency of the emission signal.

Since the data voltage Vdata serves as a reference by which the initial luminance of the organic light-emitting diode OLED disposed in each of the subpixels SP is determined, the duty ratio of the emission signal for maintaining changes in the luminance to be uniform can be set on the basis of the data voltage Vdata. In addition, the gamma value used for output of the data voltage Vdata can be used to calculate the duty ratio.

For example, when the display driving frequency and the output frequency of the emission signal are set, the one-frame period is divided into n number of periods.

The initial luminance of the first period and the last luminance of the nth period among the n number of periods can be estimated by the gamma value.

Since the luminance should be maintained to be uniform during the n number of divided periods, the duty ratio of the emission signal for adjusting the luminance of the remaining periods can be calculated on the basis of the luminance appearing in the nth period, the luminance of which is lowest due to the reduced amount of current.

That is, the length of the off-period of the emission signal in each period can be calculated, so that the luminance appearing in the first period to the (n−1)th period of the n number of divided periods is the same as the luminance of the nth period. In addition, the length of the off-period of the emission signal may be longest in the first period having highest luminance, and may gradually decrease.

The duty ratio of the emission signal, set on the basis of the display driving frequency and the output frequency of the emission signal as described above, can be stored in a look-up table. The PWM emission signal can be output on the basis of the duty ratio obtained from the data voltage Vdata, supplied to the subpixels SP in the low-power mode, and the output frequency of the emission signal.

Alternatively, the PWM emission signal can be output by sensing the degree by which a current flowing through the organic light-emitting diode OLED is reduced, instead of previously setting the duty ratio at which the pulse width of the emission signal is modulated.

Figure 7:
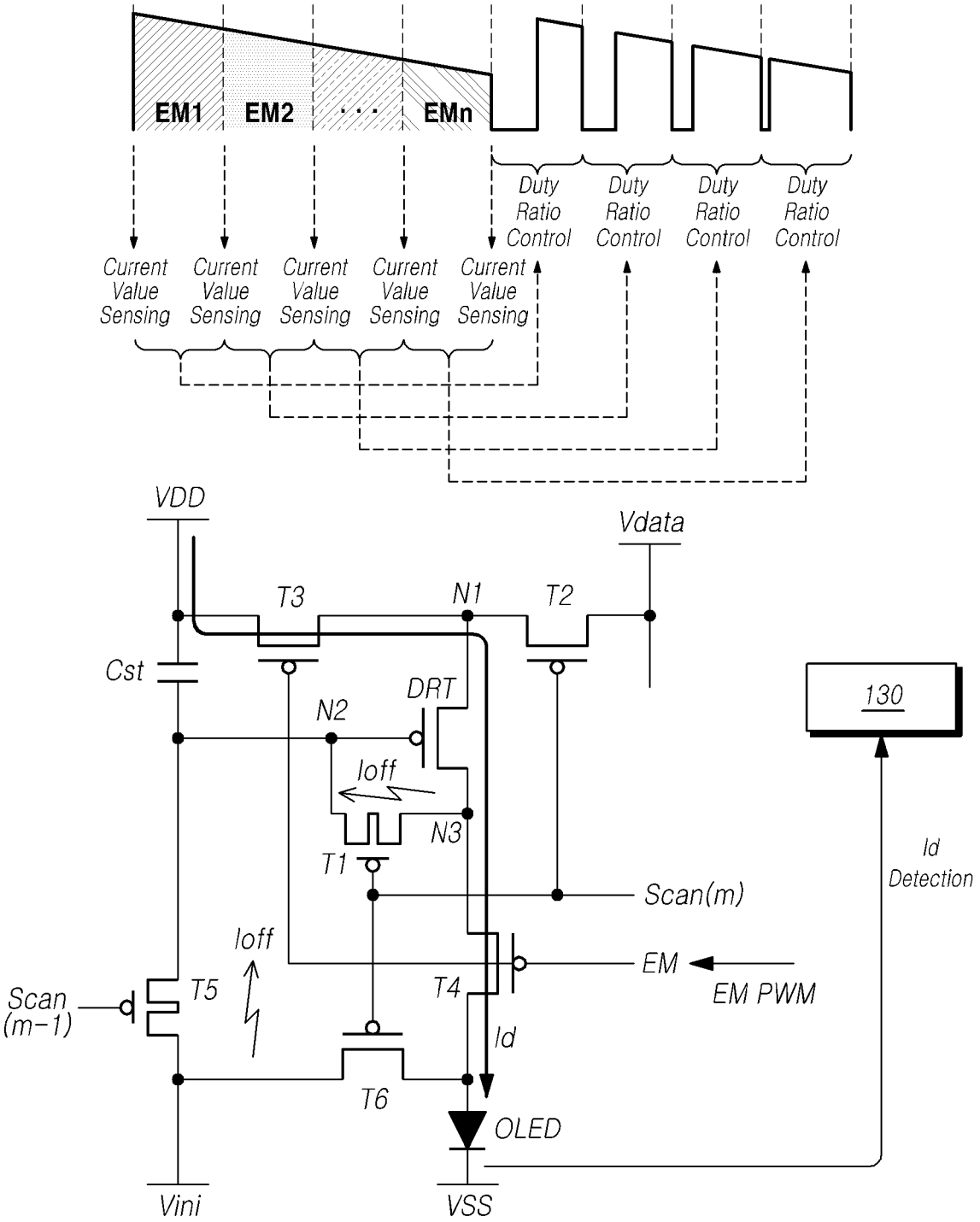
FIG. 7 illustrates another example of the method in which the display device according to embodiments sets the pulse width of the emission signal.

FIG. 7 illustrates another example of the method in which the display device 100 according to embodiments sets the pulse width of the emission signal.

Referring to FIG. 7, in each of the divided periods or at points in time on the boundary of each of the divided periods during the one-frame period, a current flowing through the organic light-emitting diode OLED can be sensed, and a duty ratio of the emission signal can be set on the basis of the sensed value.

For example, a change in current flowing through the organic light-emitting diode OLED can be detected by sensing a current from a base voltage line electrically connected to a cathode of an organic light-emitting diode OLED disposed in a subpixel SP.

The current sensing can be performed by the data driver circuit 130, at points in time on boundaries of n number of divided periods in a one-frame period. Alternatively, the current sensing can be performed at a start point and an end point of the one-frame period ends.

It is possible to calculate changes in luminance during the one-frame period by detecting changes in current flowing through the organic light-emitting diode OLED during the one-frame period.

In addition, in the one-frame period, a luminance according to a current sensing value sensed in the nth period among the n number of divided periods can be used as a reference, on the basis of which the duty ratio of the emission signal for adjusting the luminance of the remaining periods to be uniform is set.

As described above, the PWM emission signal can be output in a next frame according to the duty ratio set on the basis of a current sensing value, so that the luminance can be maintained to be uniform during the frame period and a luminance change can be reduced.

Figure 8:
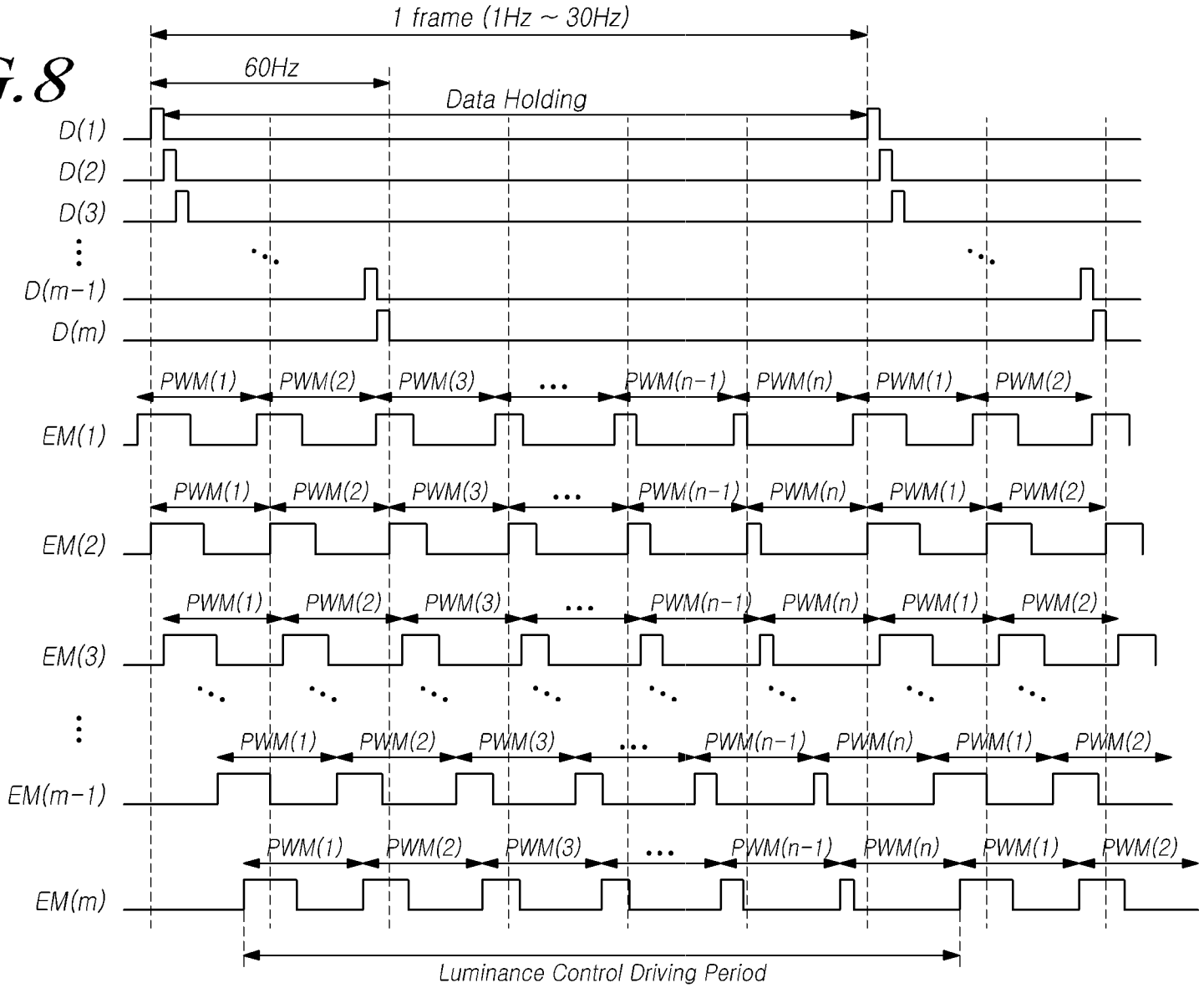
FIG. 8 illustrates a specific example in which the display device according to embodiments outputs a PWM emission signal in a low-power mode.

FIG. 8 illustrates a specific example in which the display device 100 according to embodiments outputs a PWM emission signal in a low-power mode.

Referring to FIG. 8, data voltages Vdata D(1), . . . , and D(m) are supplied to subpixels SP connected tom number of gate lines GL in a data update period of a one-frame period. In addition, during the period in which each of the data voltages Vdata is supplied, the emission signal applied to the subpixels SP, to which the data voltage Vdata is supplied, can maintain an off level.

Here, the off-level period of the emission signal can be longer than the period in which the data voltage Vdata is supplied, in consideration of the compensation period of the driving transistor DRT of each of the subpixels SP.

One or more PWM emission signals can be applied to each of the subpixels SP in the data retaining period after the data update period. In addition, the lengths of the off periods of the emission signals, applied in the data retaining period, can be gradually decreased.

Here, the period of the emission signal applied in the data update period and the period of the emission signal applied in the data retaining period may be the same. In addition, the length of the off period of the emission signal applied in the data update period can be longest, while the length of the off period of the emission signal applied after the data update period can be gradually decreased.

That is, the one-frame period including the data update period and the data retaining period can be divided into n number of periods, in each of which an emission signal can be applied. The length of the off period of the emission signal can be gradually decreased.

Thus, luminance appearing in the period corresponding to each emission signal in the one-frame period can be maintained to be uniform, and the entirety of the frame period can be regarded as a luminance control driving period.

Such pulse width modulation of the emission signal can be performed by modulating the width of one of signals input into the gate driver circuit 120 that outputs the emission signal.

Figure 9:
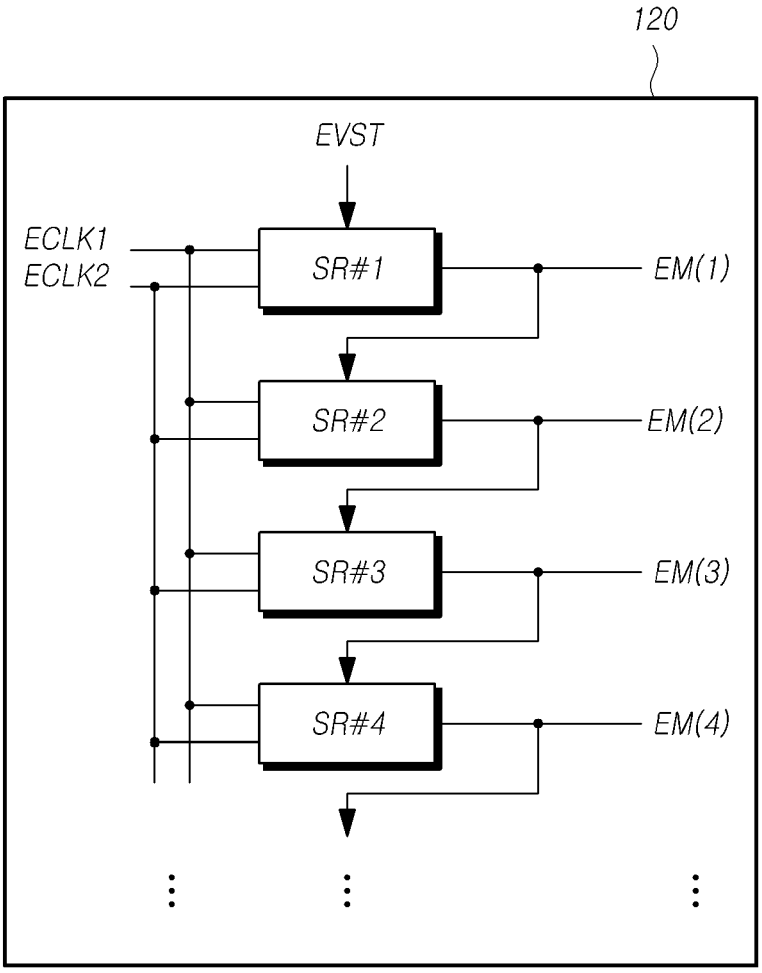
FIG. 9 illustrates an example of a structure of the gate driver circuit according to embodiments.

FIG. 9 illustrates an example of a structure of the gate driver circuit 120 according to embodiments.

Referring to FIG. 9, the gate driver circuit 120 may include a plurality of shift registers to output emission signals to the plurality of gate lines GL, disposed in the display panel 110, respectively.

Each of the shift registers can receive an emission start signal EVST, emission clock signals ECLK1 and ECLK2, and the like, and can output an emission signal having a high level and a low level, on the basis of an input signal.

The emission start signal EVST serves to control the output of an emission signal, and may be input to the shift register SR#1 among the plurality of shift registers.

The shift register SR#1 can output an emission signal EM(1) by receiving the emission start signal EVST. The output emission signal EM(1) can be input into the shift register SR#2 to serve as a start signal.

Although the emission clock signals ECLK1 and ECLK2 are illustrated as two emission clock signals having different phases by way of example, the emission clock signals may be two, four, eight, or another number of emission clock signals.

Due to the emission clock signals ECLK1 and ECLK2, the voltage levels of node Q and node QB in the shift registers can be controlled, and the emission signal can be output.

Here, the PWM emission signal can be output by modulating the width of the emission start signal EVST used for output of the emission signal.

Figure 10:
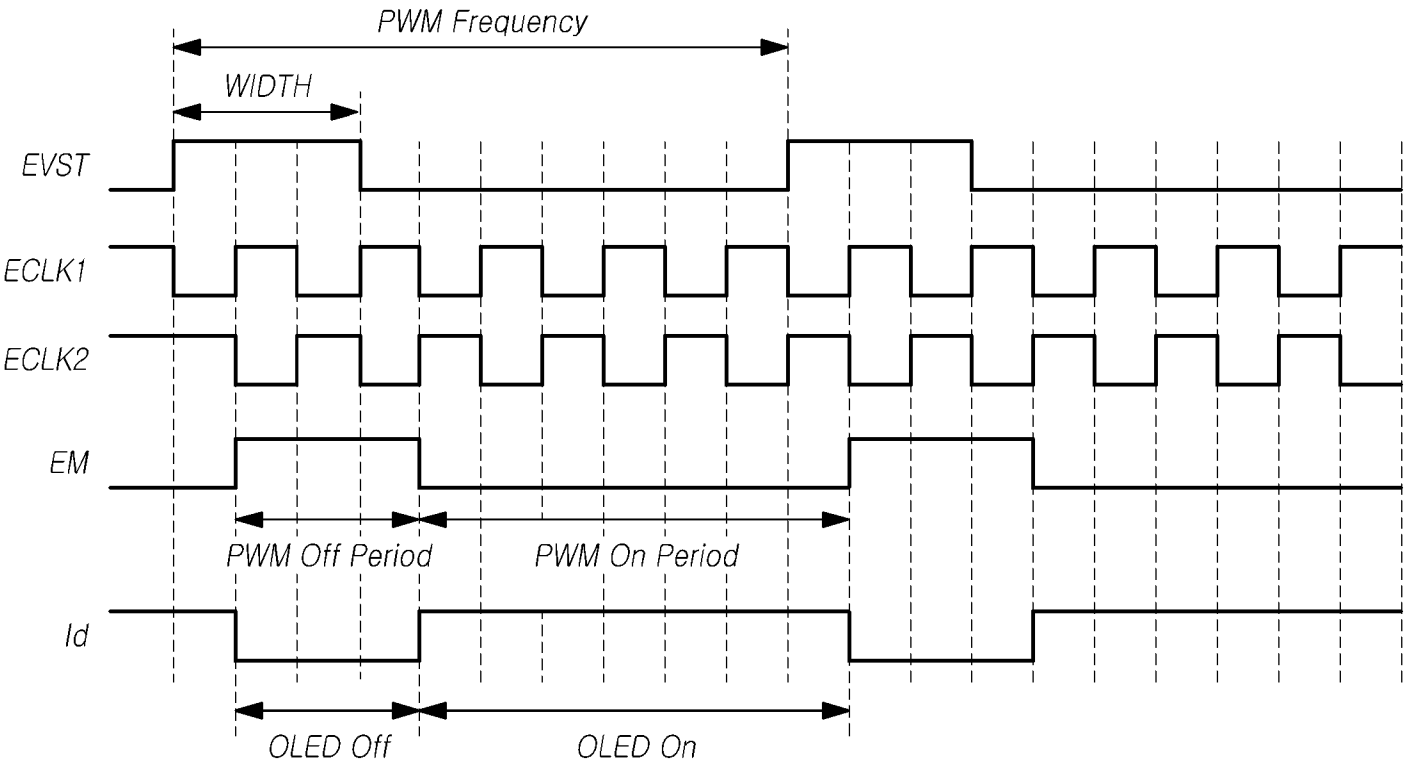
FIG. 10 is an example of a timing diagram of the emission signal output by the gate driver circuit illustrated in FIG. 9.

FIG. 10 is an example of a timing diagram of the emission signal output by the gate driver circuit 120 illustrated in FIG. 9.

Referring to FIG. 10, the emission start signal EVST can be input to a shift register of the gate driver circuit 120 during a portion of the one-frame period, corresponding to an output frequency of the emission signal. The emission start signal EVST can have a high level and a low level with a predetermined width.

In addition, the emission clock signals ECLK1 and ECLK2 having different phases can be input to the shift register of the gate driver circuit 120.

The shift register can output the emission signal having the same width as, and delayed from, the emission start signal EVST. Thus, the period in which the emission signal is at the high level and the period in which the emission signal is at the low level can be the same as those of the emission start signal EVST.

The period in which the emission signal is at the high level may be regarded as a period in which the organic light-emitting diode OLED is in an off state, since the light-emitting transistor is turned off. In addition, the period in which the emission signal is at the low level may be regarded as a period in which the organic light-emitting diode OLED is in an on state, since the light-emitting transistor is turned on.

As described above, the emission start signal EVST is applied to the shift register of the gate driver circuit 120 in a width-modulated state, so that the pulse width of the emission signal output during the frame period can be modulated.

In addition, it is possible to apply a number of emission start signals EVST having different pulse widths to the shift registers of the gate driver circuit 120 in the one-frame period, so that a number of emission signals having different pulse widths can be output during the one-frame period.

Accordingly, luminance control driving using the number of emission signals output during the one-frame period can be performed in order to maintain luminance to be uniform and reduce luminance changes during the frame period.

Figure 11:
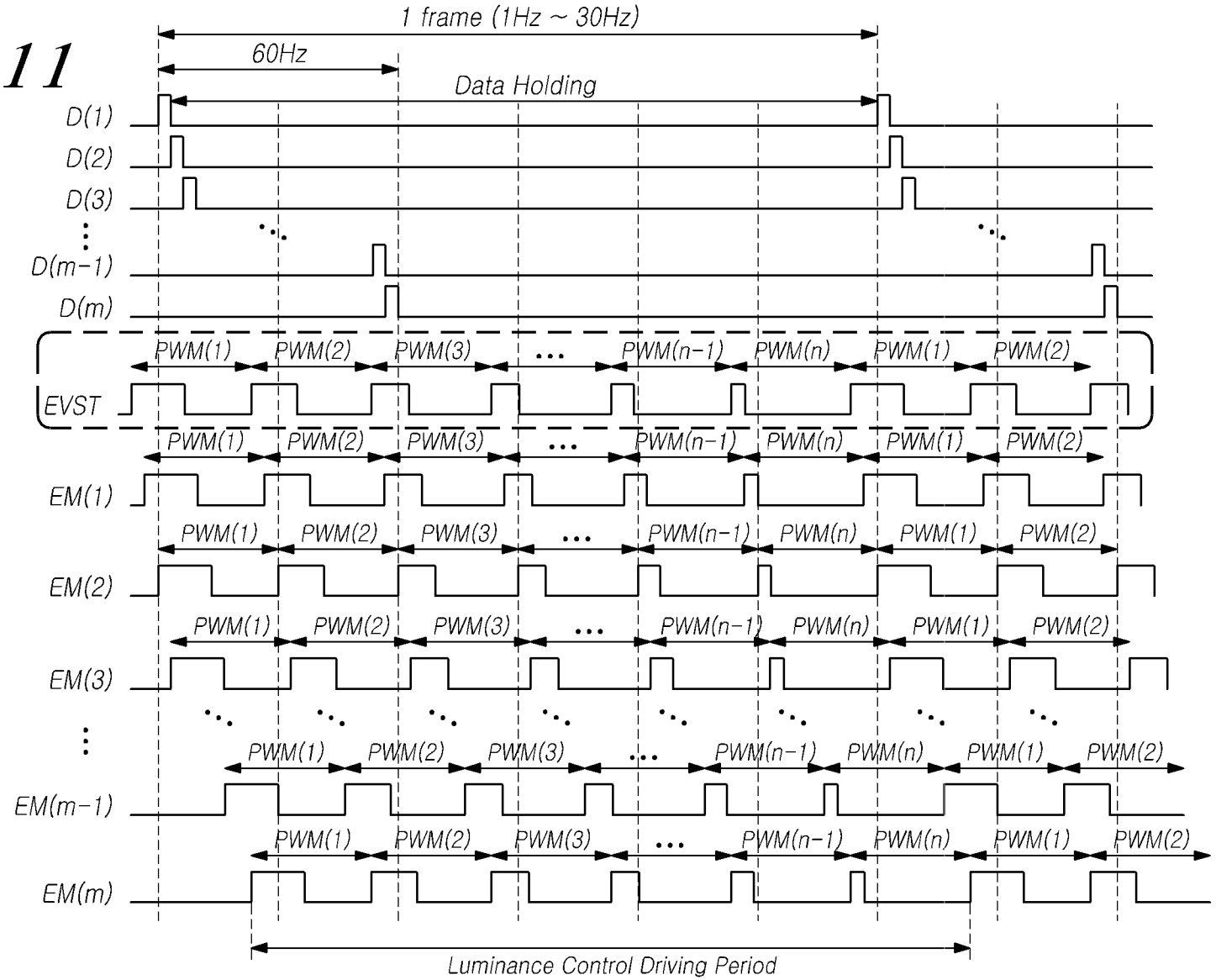
FIG. 11 illustrates an example in which the PWM emission signal is output by the gate driver circuit illustrated in FIG. 9.

FIG. 11 illustrates an example in which the PWM emission signal is output by the gate driver circuit 120 illustrated in FIG. 9.

Referring to FIG. 11, the data voltage Vdata is supplied to each of the subpixels SP in the data update period of the one-frame period.

Here, the first emission start signal EVST can be input to a shift register of the gate driver circuit 120 according to the data update period. In addition, the emission signal having a pulse width corresponding to the width of the emission start signal EVST, input to the shift register, can be input to each of the subpixels SP.

In addition, in the data retaining period after the data update period, a second emission start signal EVST, the high level period of which is shorter than that of the first emission start signal EVST, is input to the next shift register of the gate driver circuit 120.

Accordingly, a subsequent emission signal, the length of the off period of which is shorter than that of the previous emission signal applied in the data update period, is input to each of the subpixels SP.

As described above, a number of emission start signals EVST having different pulse widths can be input to the gate driver circuit 120, so that the gate driver circuit 120 can output a number of PWM emission start signals in the one-frame period.

In addition, as the amount of current flowing through the organic light-emitting diode OLED is reduced, the off period of the emission signal decreases, i.e., the length of the on period of the emission signal increases. Accordingly, in the period corresponding to each of the emission signals, luminance expressed by the organic light-emitting diode OLED can be maintained to be uniform.

Since such pulse width modulation of the emission signals is performed in the period including the data update period and the data retaining period, the entirety of the one-frame period may be regarded as the luminance control driving period.

Figure 12:
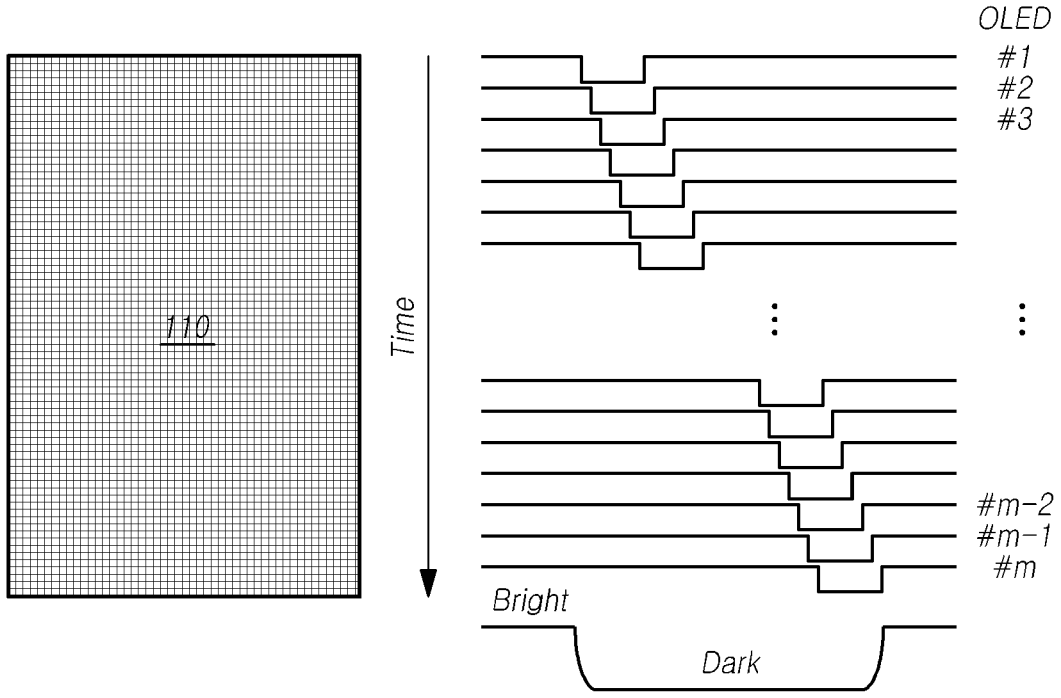
FIG. 12 illustrates an example of changes in the luminance of the display panel, represented by the output of the emission signals illustrated in FIG. 11.

FIG. 12 illustrates an example of changes in the luminance of the display panel 110, represented by the output of the emission signals illustrated in FIG. 11.

Referring to FIG. 12, in the luminance control driving period of the frame period, the PWM emission signals are applied to the subpixels SP, respectively. Since the PWM emission signals are output by the emission start signals EVST input to the shift registers of the gate driver circuit 120, the PWM emission signals directed to the subpixels SP are sequentially output.

Accordingly, changes in luminance, appearing on the display panel 110 in the off period of the emission signal during the luminance control driving period, can be observed in the form of a sine wave.

As described above, the PWM emission signals can be output using the emission start signals EVST input to the shift registers of the gate driver circuit 120. The PWM emission signals can be output using an emission reset signal EM RESET for resetting the gate lines GL to which the emission signals are applied.

Figure 13:
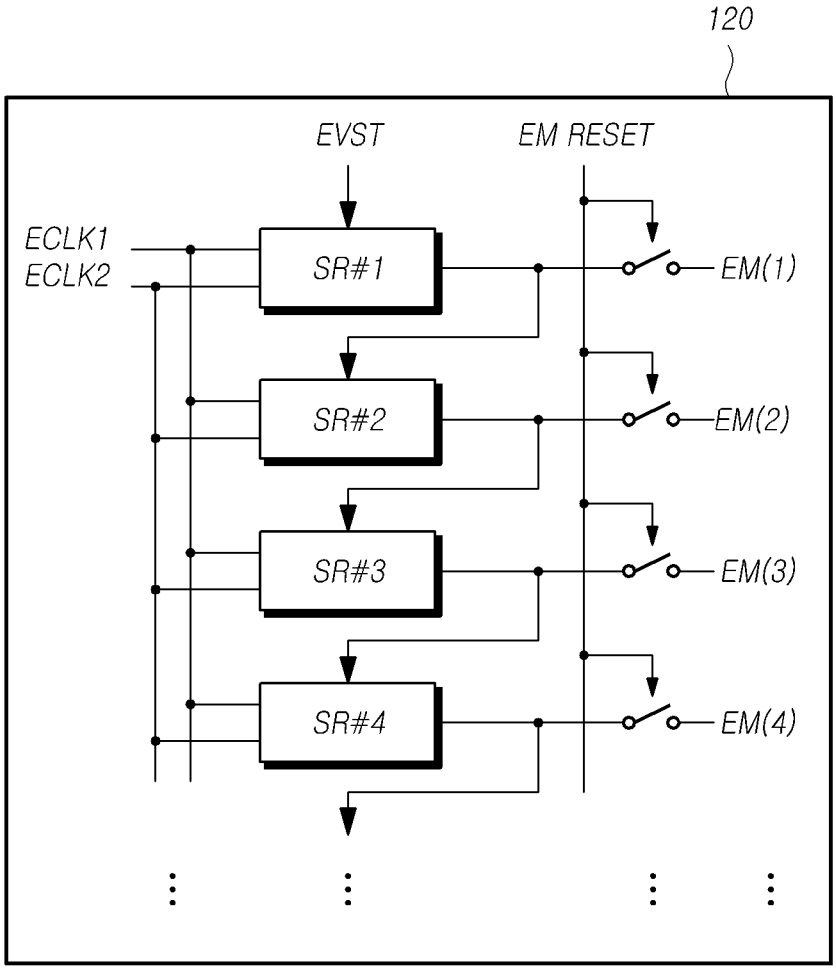
FIG. 13 illustrates another example of the structure of the gate driver circuit according to embodiments.

FIG. 13 illustrates another example of the structure of the gate driver circuit 120 according to embodiments.

Referring to FIG. 13, the gate driver circuit 120 may include a plurality of shift registers to output emission signals to the plurality of gate lines GL disposed in the display panel 110.

Each of the shift registers can receive an emission start signal EVST, emission clock signals ECLK1 and ECLK2, and the like, and can output an emission signal having a high level and a low level, on the basis of an input signal.

An EM reset signal for resetting the gate lines GL, to which the emission signals are applied, may be applied to an emission signal output terminal of each of the shift registers.

The EM reset signal EM RESET can be concurrently applied to emission signal output terminals of the plurality of shift registers. It is possible to control pulse widths of the emission signals output from the shift registers by the EM reset signal EM RESET.

For example, each of the shift registers outputs the emission signal having a level, at which the light-emitting transistor is turned off, in the data update period of the frame period. Here, the emission signal output terminal and the corresponding gate line GL may have been electrically connected by the EM reset signal EM RESET.

In the data retaining period after the data update period, a switch connected between the emission signal output terminal and the corresponding gate line GL can be turned on or off by applying the EM reset signal EM RESET, so that the PWM emission signal can be applied to each gate lines GL.

In addition, it is possible to control the length of the off period of the emission signal, output in the data retaining period, to gradually decrease by adjusting the period in which the EM reset signal EM RESET is on or off.

Accordingly, due to the PWM emission signals being applied to the subpixels SP, respectively, during the frame period, the degree in which luminance varies can be reduced and the luminance can be maintained to be uniform.

Figure 14:
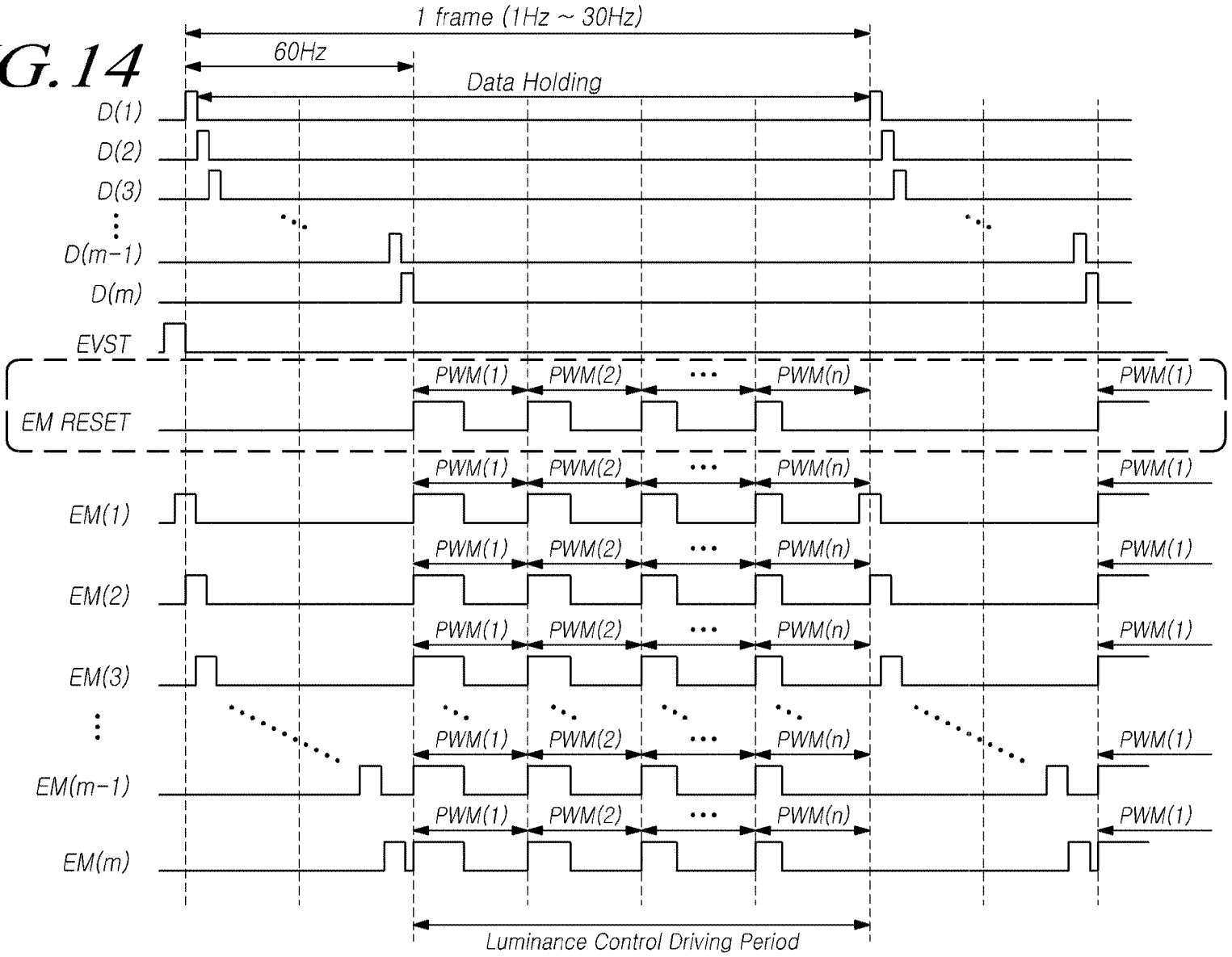
FIG. 14 illustrates an example in which PWM emission signals are output by the gate driver circuit.

FIG. 14 illustrates an example in which PWM emission signals are output by the gate driver circuit 120.

Referring to FIG. 14, a data voltage Vdata is supplied to each of the subpixels SP in a data update period of a one-frame period.

Here, the emission start signal EVST can be input one time to the first shift register of the gate driver circuit 120. In addition, the emission signal output from each of the shift registers can be input to the next shift register to serve as a start signal.

When data update for each of the subpixels SP is completed, the EM reset signal EM RESET is applied in the subsequent period, so that the on/off level of the emission signal supplied to each of the subpixels SP can be adjusted.

The emission signal can have a pulse width corresponding to that of the EM reset signal EM RESET, and can be applied to the light-emitting transistor to control on/off of the light-emitting transistor. The length of the off period of the emission signal can gradually decrease.

Accordingly, as the PWM emission signal is applied, the light-emitting transistor can be turned on or off, thereby turning the organic light-emitting diode OLED on or off. In addition, gradually reducing the period in which the organic light-emitting diode OLED is turned off, in the period corresponding to each of the emission signals, can reduce changes in the luminance of organic light-emitting diode OLED and maintain the luminance to be uniform.

Here, in a case in which the PWM emission signal is output using the EM reset signal EM RESET, the EM reset signal EM RESET is applied after the data update of the plurality of subpixels SP is completed, so that the luminance control driving period can be at least a portion of the data retaining period.

Figure 15:
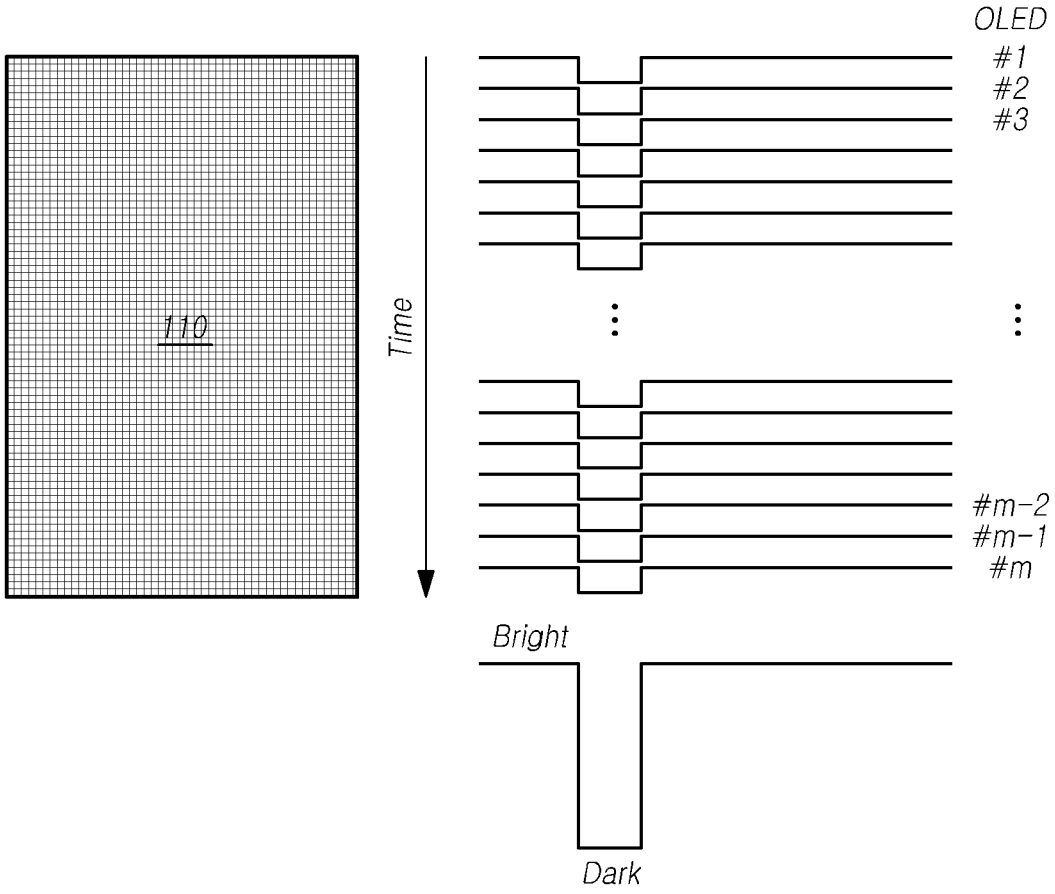
FIG. 15 illustrates an example of changes in the luminance of the display panel appearing due to the output of the emission signal illustrated in FIG. 14.

FIG. 15 illustrates an example of changes in the luminance of the display panel 110 appearing due to the output of the emission signal illustrated in FIG. 14.

Referring to FIG. 15, the PWM emission signal is applied to each of the subpixels SP in the luminance control driving period of the frame period. In addition, since the PWM emission signal is output to correspond to the EM reset signal EM RESET applied to the gate driver circuit 120, the PWM emission signals applied to the subpixels SP, respectively, are concurrently output.

Accordingly, changes in luminance appearing in the off period of the emission signal, among the luminance control driving period, on the display panel 110, can be observed in the form of a square.

As described above, it is possible to output the emission signals by modulating the pulse width thereof in the luminance control driving period of the frame period using the EM reset signal EM RESET input to the gate driver circuit 120.

In addition, in a period of the luminance control driving period, corresponding to each of the emission signals, it is possible to maintain the luminance of the organic light-emitting diode OLED to be uniform and reduce changes in the luminance using the PWM emission signal.

Figure 16:
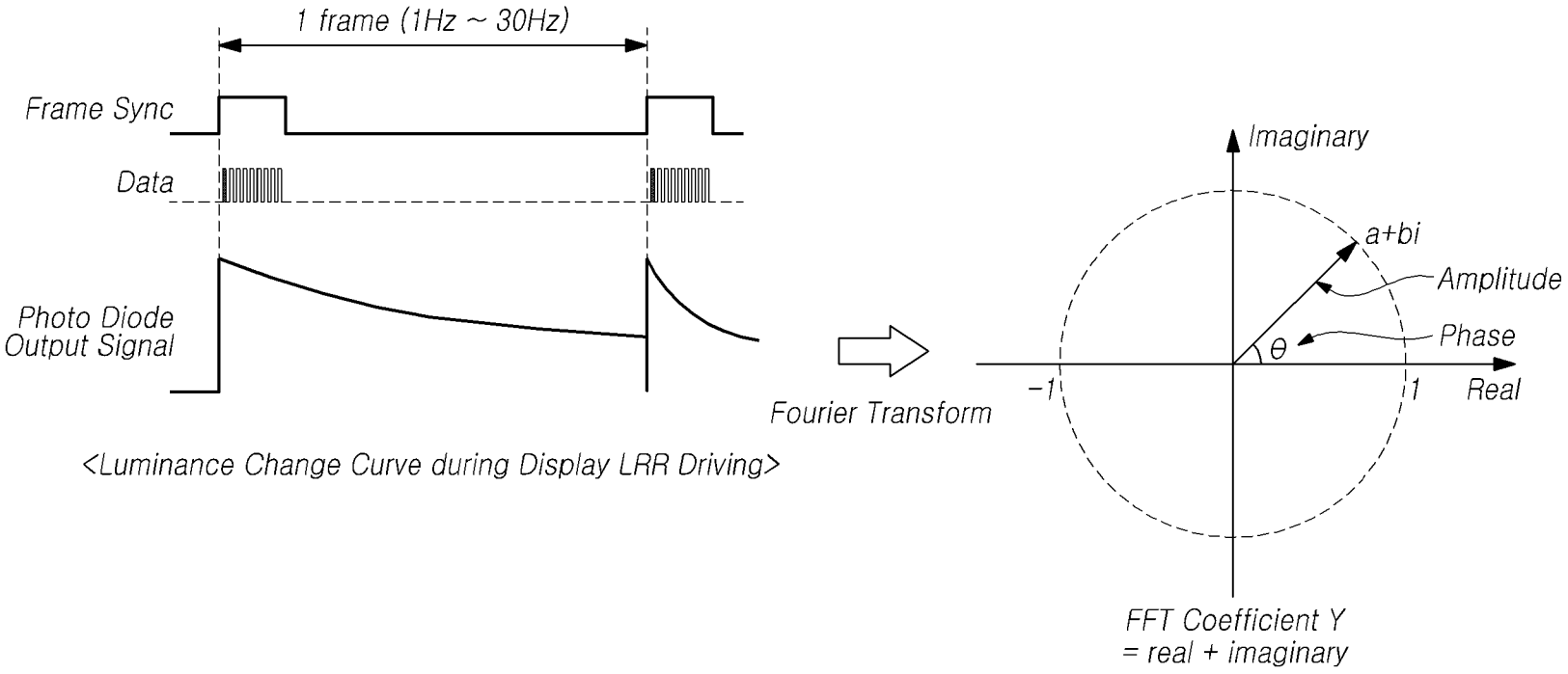
FIGS. 16 and 17 illustrate another example of a method in which the display device according to embodiments sets the pulse width of the emission signal.
Figure 17:
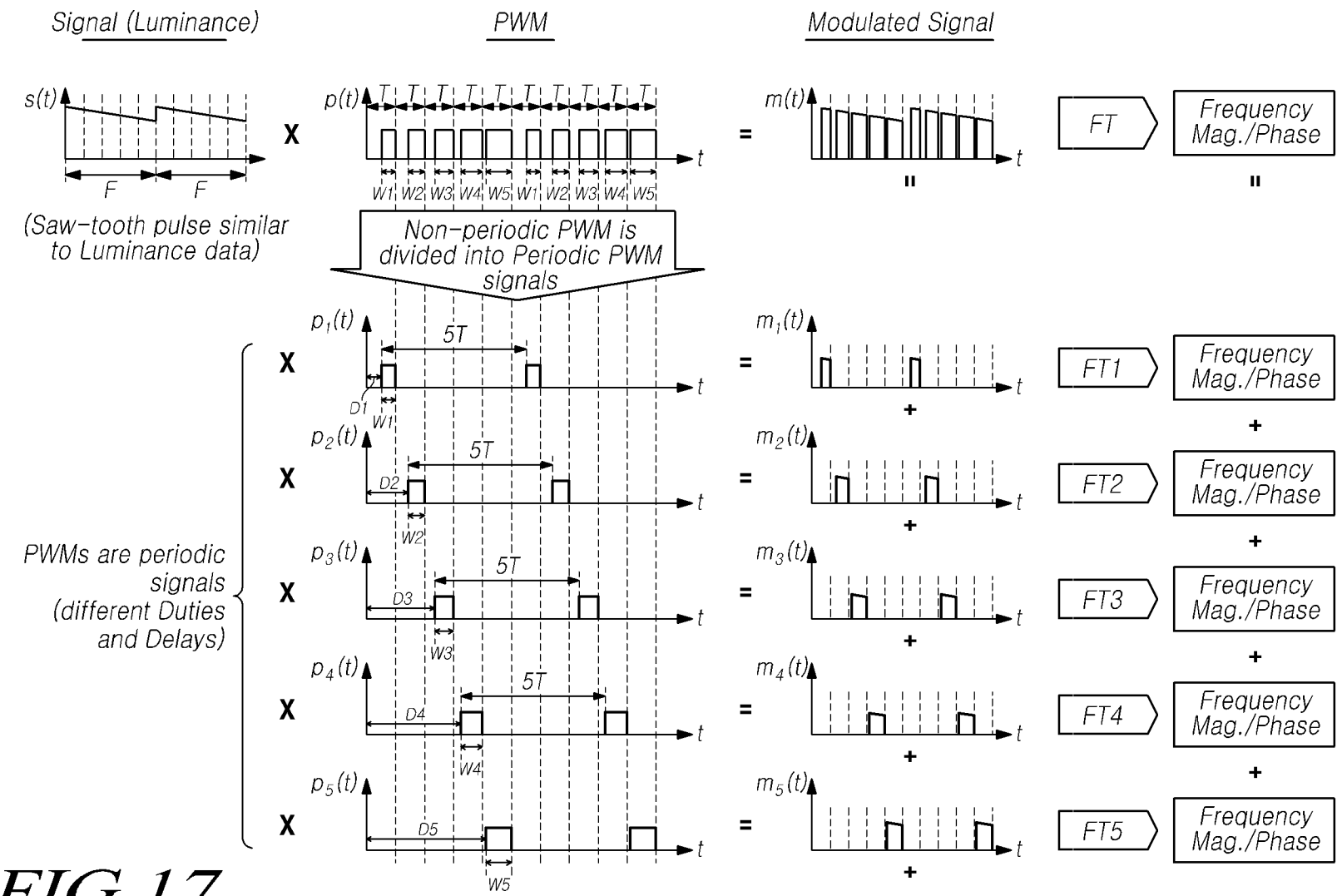

FIGS. 16 and 17 illustrate another example of a method in which the display device 100 according to embodiments sets the pulse width of the emission signal.

Referring to FIG. 16, a luminance, appearing in the one-frame period of the period in which the display device 100 is driven in the low-power mode, can be measured using a photodiode. The luminance measured using the photodiode can gradually decrease over the frame period.

Here, frequency components of the luminance appearing during the frame period can be calculated by performing the Fourier transform to the signal output by measuring the luminance using the photodiode.

Such frequency components of the luminance can be in the form of a complex number, e.g., a+bi. The amplitude or phase of the frequency components of the luminance may vary depending on the length of the frame period or luminance appearing in the frame period.

In addition, in a case in which the one-frame period is divided into a plurality of subframe periods, different emission timings or different levels of luminance appear in the respective subframe periods. Thus, luminance appearing in the subframe periods may have different frequency components.

Accordingly, it is possible to adjust frequency components of luminance appearing in the entire frame periods by adjusting frequency components appearing in each of the subframe periods.

Describing in detail with reference to FIG. 17, a modulated signal, i.e., a luminance waveform appearing according to the emission signal, can be obtained, on the basis of a pulse (e.g., saw-tooth pulse) similar to the luminance appearing in the frame period driven in the low-power mode and the emission signal applied to the light-emitting transistor during the frame period.

Here, the emission signal applied to the light-emitting transistor may be an asymmetric signal having a different delay period and a different pulse width. The emission signal can be divided into signals having the same periods. Then, on the basis of the divided signals of the emission signal and a waveform similar to luminance appearing during the frame period of the low-power mode, signals modulated according to the divided signals of the emission signal can be obtained.

Here, when each of the modulated signals is subjected to the Fourier transform, frequency components respectively having an amplitude and a phase can be produced.

That is, since the emission signals have different delay times D1, D2, D3, D4, and D5 and different pulse widths W1, W2, W3, W4, and W5, different frequency components of luminance can appear in the period corresponding to each emission signal.

In addition, when the modulated signals having different frequency components are combined, a specific frequency component can be canceled. Thus, in the entire frame period, the specific frequency component in frequency components of luminance can be reduced.

Accordingly, it is possible to vary frequency components of luminance appearing during the frame period of the low-power mode by varying at least one of the delay period, the pulse width, or a combination thereof, of each emission signal, during the one-frame period.

Here, it is possible to adjust the delay period or the pulse width of the emission signal, so that the frequency component that causes flicker is canceled, i.e., the frequency component that causes flicker, among frequency components of luminance of the frame period, is reduced, thereby preventing the flicker from being observed in the period in which driving is performed in the low-power mode.

Figure 18A:
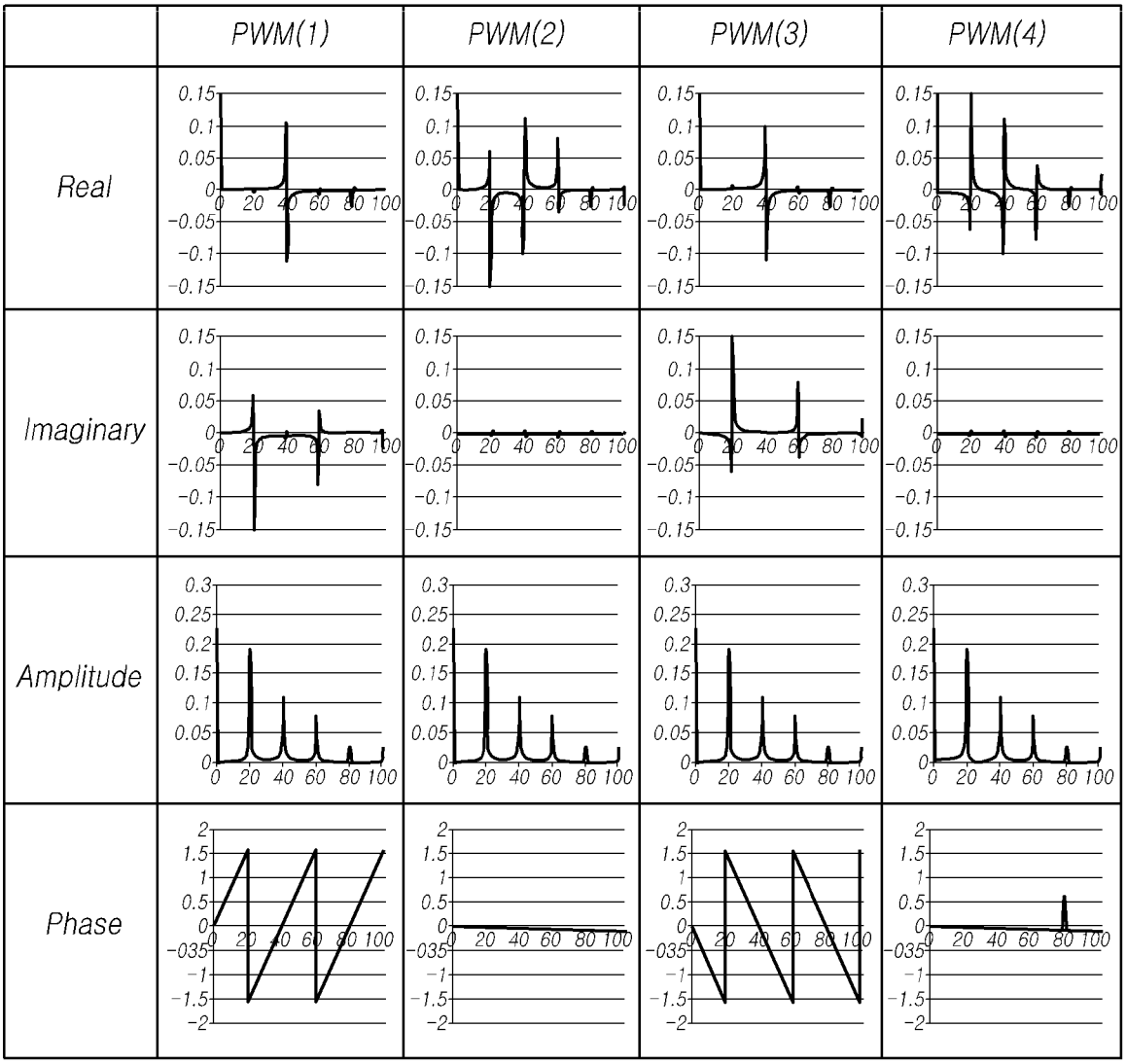
FIGS. 18A and 18B illustrate an example of frequency components of luminance appearing according to the emission signal pulse-width modulated by the method illustrated in FIGS. 16 and 17.
Figure 18B:
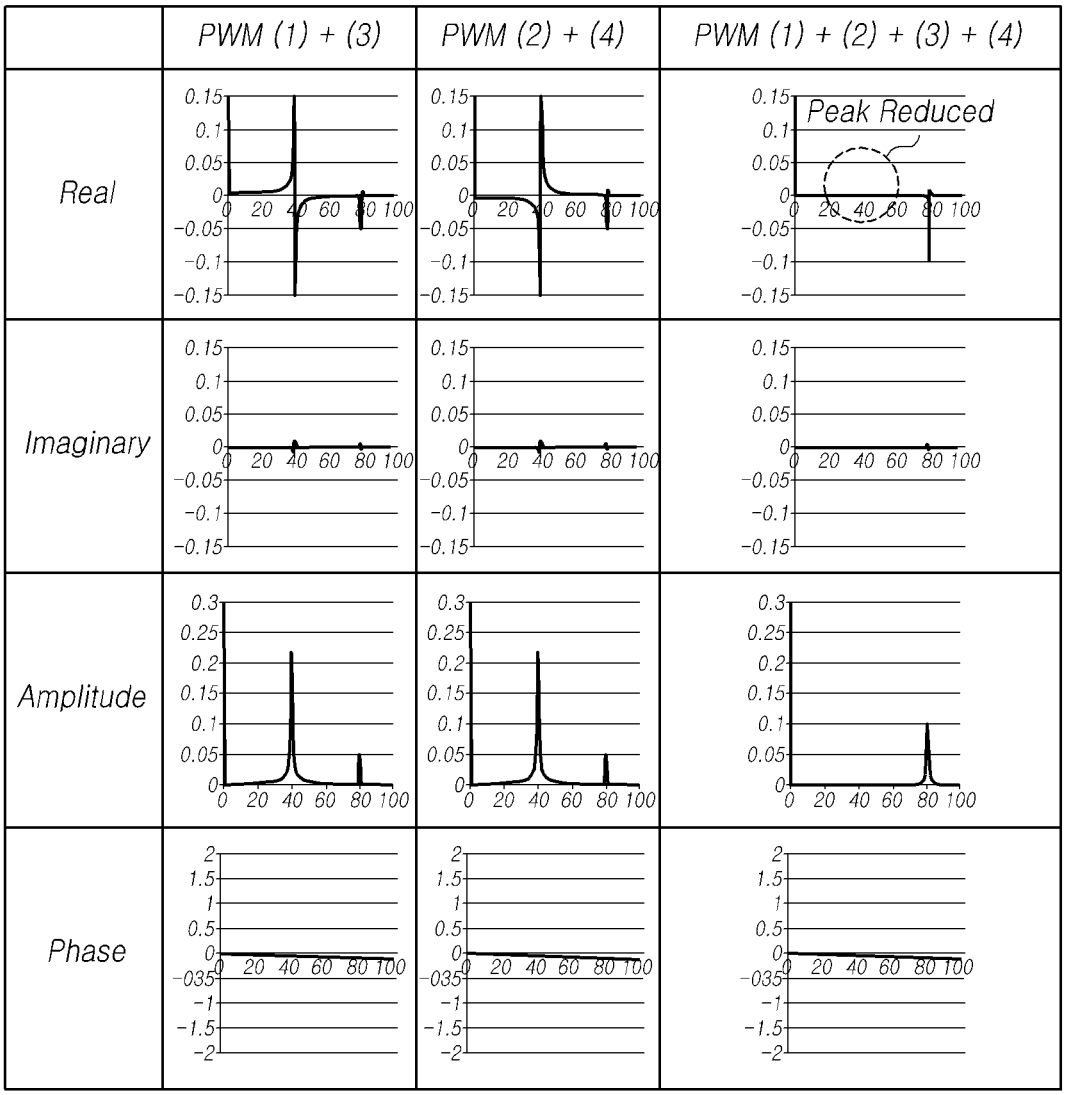

FIGS. 18A and 18B illustrate an example of frequency components of luminance appearing according to the emission signal pulse-width modulated by the method illustrated in FIGS. 16 and 17.

FIG. 18A illustrates frequency components of luminance appearing in subframe periods in a situation in which an emission signal is applied in each of the subframe periods of a one-frame period. Here, at least one of a delay period, a pulse width, or a combination thereof, of the emission signal, is varied.

Here, PWM(1) indicates frequency components of luminance of a first subframe period, and PWM(2), PWM(3), and PWM(4) indicate frequency components of luminance of second, third, and fourth subframe periods, respectively.

Frequency components appearing in each of the subframe periods may have different amplitudes and phases, due to a degree by which luminance is reduced in the corresponding frame period, the pulse width of the emission signal, or the like.

In addition, when such frequency components having different amplitudes and phases are combined, a specific frequency component can be canceled and reduced.

Referring to FIG. 18B, for example, when frequency components of luminance appearing in the first subframe period and frequency components of luminance appearing in the third subframe period are combined, or when frequency components of luminance appearing in the second subframe period and frequency components of luminance appearing in the fourth subframe period are combined, a specific frequency component can be increased even though some frequency components may be reduced.

In addition, such a specific frequency component may be a frequency component that causes flicker.

In contrast, it can be appreciated that, when frequency components of luminance appearing in the first to fourth subframe periods are combined, the specific frequency component is canceled.

That is, it is possible to cancel the specific frequency component among frequency components of luminance appearing in the entire frame period, including the first to fourth subframe periods by adjusting the pulse width of the emission signal supplied to each of the subframe periods.

Accordingly, the delay period or the pulse width of each of the emission signals can be independently adjusted, so that a specific frequency component can be avoided from frequency components of luminance appearing in the frame period. Accordingly, it is possible to prevent flicker from being observed in the low-power mode driving period.

Figure 19:
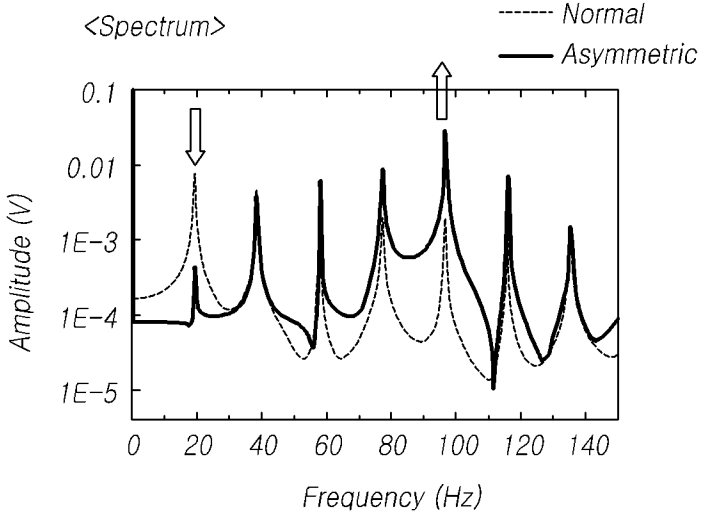
FIG. 19 illustrates simulation results of luminance and frequency components appearing according to the emission signal, the pulse width is set by the method illustrated in FIGS. 16 and 17.
Figure 19:
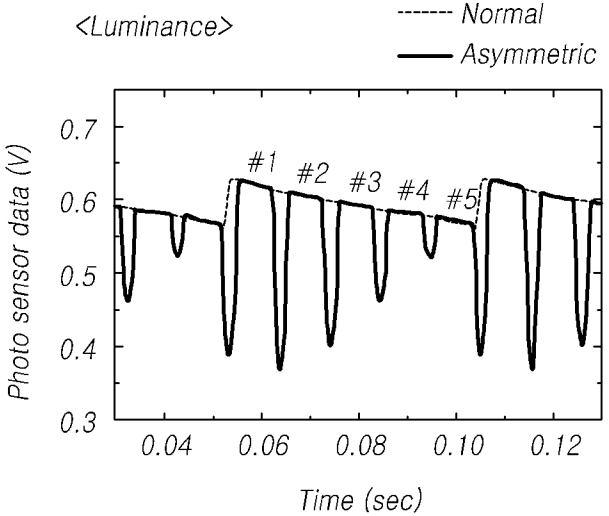

FIG. 19 illustrates simulation results of luminance and frequency components appearing according to the emission signal, the pulse width is set by the method illustrated in FIGS. 16 and 17.

Referring to FIG. 19, levels of luminance measured in a case in which the display device 100 is driven at 19 Hz and changes in the amplitudes of frequency components of the luminance are obtained by simulation.

Here, "Normal" indicates a case in which an emission signal was applied at a turn-off level in a data update period during a one-frame period of low-power mode driving, and then, maintained a turn-on level.

In this case, it can be appreciated that luminance gradually decreased during the one-frame period.

In addition, it can be appreciated that frequency components of luminance appearing in this frame period had a high amplitude at 20 Hz bandwidth, similar to the display driving frequency of the display device 100.

In contrast, "Asym." indicates a case in which a one-frame period driving in a low-power mode was divided into five subframe periods, to each of which a PWM emission signal was applied.

For example, in the five subframe periods, the emission signal can maintain a turn-on level at different ratios, such as 93.5%, 92%, 93.5%, 96%, and 98.5%.

In this case, it can be appreciated that luminance appearing during the one-frame period was reduced, and then, was increased at points at which the emission signal is at a turn-off level.

In addition, it can be appreciated that the amplitude of the frequency component of the 20 Hz bandwidth, among frequency components of luminance appearing in the frame period, was reduced, due to the adjustment of the pulse-width of the emission signal.

In addition, it can be appreciated that a flicker factor was reduced from −42.5 dB to −58.3 dB in Asym., compared to Normal.

That is, at least one of the delay period, the pulse width, or a combination thereof, can be varied, so that the frequency component that causes flicker can be avoided from frequency components of luminance appearing in the frame period. Accordingly, this can prevent or reduce the phenomenon in which flicker is observed in the low-power mode.

Figure 20:
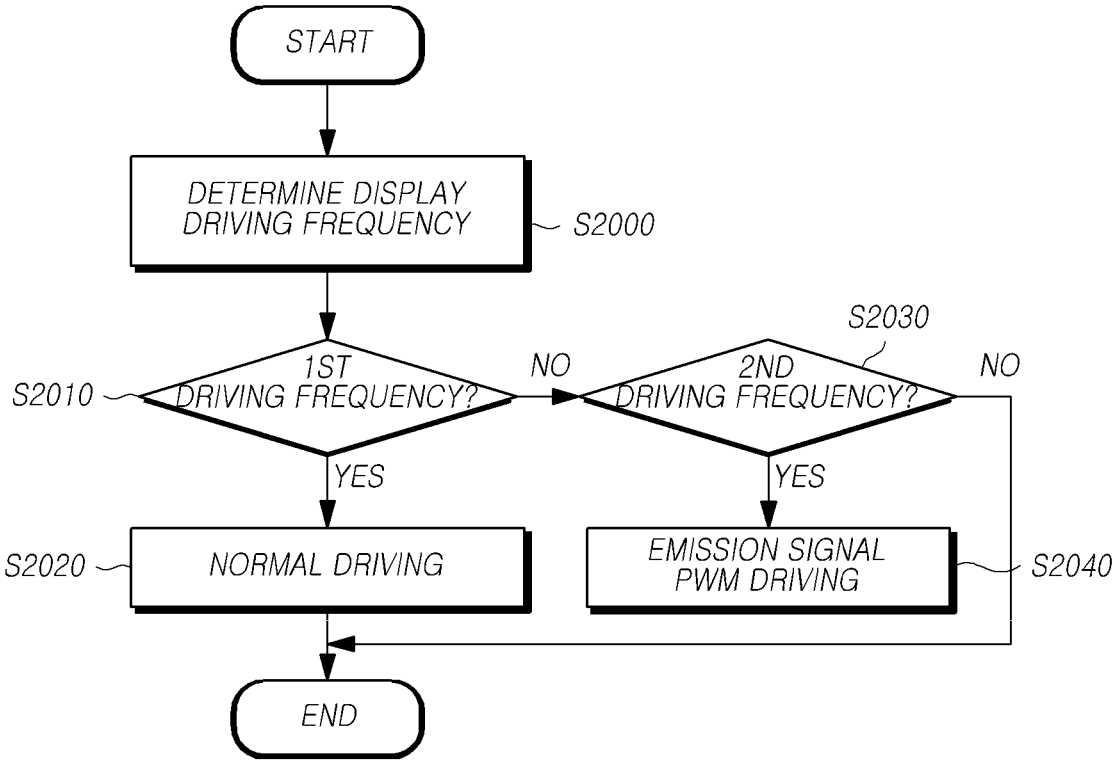
FIG. 20 is a process flowchart illustrating a method of driving the display device according to embodiments.

FIG. 20 is a process flowchart illustrating a method of driving the display device 100 according to embodiments.

Referring to FIG. 20, the display device 100 can be driven in a normal mode and a low-power mode, and a display driving frequency is determined depending on the normal mode and the low-power mode, in S2000.

In a case in which the display device 100 is driven at a first driving frequency in the normal mode in S2010, the display device 100 can output a single emission signal in a one-frame period by operating in the normal mode in S2020. Alternatively, in some cases, the display device 100 may output a number of emission start signals having a predetermined pulse width in the normal mode.

In addition, in a case in which the display device 100 is driven in the low-power mode and at a second driving frequency lower than the first driving frequency in S2030, the display device 100 can output a PWM emission signal during a luminance control driving period, i.e., at least a portion of the frame period, in S2040.

Here, the length of the off-period of each emission signal output in the luminance control driving period can be set to gradually decrease, so that luminance can be maintained to be uniform and the degree of luminance change can be reduced during the period corresponding to the emission signal.

Alternatively, at least one of the delay period, the pulse width, or a combination thereof, of each emission signal can be varied so as to reduce a frequency component that causes flicker, from among frequency components of luminance. Accordingly, the frequency component that causes flicker can be avoided during the low-power mode driving period, so that flicker can be reduced.

In addition, the foregoing embodiments can be applied in a situation in which the display device 100 is a liquid crystal display (LCD) device.

For example, in a period in which the display device 100 is driven in the normal mode, a light source included in a backlight unit can be driven using a signal having a predetermined pulse width. In addition, in a period in which the display device 100 is driven in the low-power mode, a signal by which the light source in the backlight unit is driven can be supplied, with the pulse width thereof being varied.

That is, in the low-power mode driving period, the light source in the backlight unit can be driven using the signal having the controlled pulse width, so that the frequency component that causes flicker can be avoided.

Here, not only the pulse width of the signal by which the light source is driven, but also at least one of the frequency, amplitude, the delay period, or a combination thereof, of the signal, can be controlled.

That is, during the low-power mode driving period, at least one of the driving frequency, the ratio of the emission period, the luminance level of emission, the emission start timing of the light source in the backlight unit, or a combination thereof, can be controlled to adjust frequency components of luminance expressed by the backlight unit, so that flicker is not observable.

When the backlight unit is an edge-lit backlight unit, a signal having a varied pulse width or the like can be supplied to channels through which a driving signal of the light source is supplied. When the backlight unit is a direct-lit backlight unit, the pulse width of each of signals by which respective light sources are driven can be varied, so that flicker appearing in the low-power mode can be reduced.

According to the foregoing embodiments, when the display device 100 is driven at a low display driving frequency, a number of PWM emission signals can be output in the luminance control driving period, at least a portion of the frame period, so that the luminance of the organic light-emitting diode can be maintained to be uniform.

In addition, the degree by which the luminance of the organic light-emitting diode is changed can be reduced during the frame period in order to prevent flicker caused by reduced luminance during the data retaining period and enable low frequency driving to be performed reliably, thereby reducing power consumption.

In addition, the delay period or the pulse width of the emission signal can be adjusted so that a frequency component that causes flicker can be avoided from frequency components of luminance appearing during the frame period. Accordingly, a predetermined level of luminance can be maintained and no flicker can be observed during the frame period.

As described above, it is possible to prevent flicker from being observed in the low-power mode, so that the display device 100 can be driven at a lower display driving frequency, thereby reducing the power consumption of the display device 100 and improving the efficiency thereof.

The above description and the accompanying drawings provide an example of the technical idea of the present disclosure for illustrative purposes. Those having ordinary knowledge in the technical field, to which the present disclosure pertains, will appreciate that various modifications and changes in form, such as combination, separation, substitution, and change of a configuration, are possible without departing from the essential features of the present disclosure. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a display panel including a plurality of gate lines, a plurality of data lines, and a plurality of subpixels;

a gate driver circuit configured to drive the plurality of gate lines; and a data driver circuit configured to drive the plurality of data lines, wherein each of the plurality of subpixels includes:

a light-emitting element;

a driving transistor configured to drive the light-emitting element; and a light-emitting transistor electrically connected between the light-emitting element and the driving transistor, the light-emitting transistors of the plurality of subpixels are controlled by the plurality of gate lines, during a driving period in a low-power mode, the gate driver circuit outputs a plurality of emission signals to a corresponding gate line among the plurality of gate lines in a luminance control driving period that is at least a portion of a one-frame period, a delay time, a pulse width, or a combination thereof of a first emission signal among the plurality of emission signals is different from a delay time, a pulse width, or a combination thereof, respectively, of a second emission signal among the plurality of emission signals.

2. The display device according to claim 1, wherein a total of a length of a delay time and a length of a pulse width of each of the plurality of emission signals is constant.

3. The display device according to claim 1, wherein a total of a length of a delay period and a length of the pulse width of the first emission signal is smaller than a total of a length of a delay period and a length of the pulse width of the second emission signal.

4. The display device according to claim 1, wherein the second emission signal is outputted subsequent to the first emission signal, and the pulse width of the second emission signal is larger than the pulse width of the first emission signal.

5. The display device according to claim 1, wherein the gate driver circuit outputs emission signals to different gate lines among the plurality of gate lines in a corresponding period of the luminance control driving period, a delay time, a pulse width, or a combination thereof of one emission signal of the emission signals outputted to the different gate lines is different from a delay time, a pulse width, or a combination thereof, respectively, of another emission signal of the emission signals outputted to the different gate lines.

6. The display device according to claim 1, wherein a frequency component having a maximum amplitude, among frequency components of luminance measured in the one-frame period, is located in a bandwidth other than a driving frequency bandwidth of the low-power mode.

7. The display device according to claim 1, wherein delay periods and pulse widths of the plurality of emission signals are determined according to a driving frequency of the low-power mode, a data voltage supplied through a corresponding data line among the plurality of data lines, or a combination thereof.

8. The display device according to claim 1, wherein, during a driving period in a normal mode, the gate driver circuit outputs a single emission signal or the plurality of emission signals having a predetermined delay period and a predetermined pulse width in the one-frame period.

9. The display device according to claim 1, wherein the luminance control driving period is a period including a data update period and a data retaining period of the one-frame period or is at least a portion of the data retaining period.

* * * * *